US012758817B2

(12) United States Patent
Delfin et al.

(10) Patent No.: US 12,758,817 B2
(45) Date of Patent: Oct. 13, 2026

(54) ALIGNMENT MAT

(71) Applicant: LULULEMON ATHLETICA CANADA INC., Vancouver (CA)

(72) Inventors: Josh Nehru Samonte Delfin, Vancouver (CA); William Ly, Vancouver (CA)

(73) Assignee: Lululemon Athletica Canada Inc., Vancouver (CA)

( * ) Notice: Subject to any disclaimer, the term of this patent is extended or adjusted under 35 U.S.C. 154(b) by 120 days.

(21) Appl. No.: 18/776,628

(22) Filed: Jul. 18, 2024

(65) Prior Publication Data

US 2025/0032848 A1 Jan. 30, 2025

Related U.S. Application Data

(60) Provisional application No. 63/515,477, filed on Jul. 25, 2023.

(51) Int. Cl.
*A63B 21/00* (2006.01)

(52) U.S. Cl.
CPC ..... *A63B 21/4037* (2015.10); *A63B 2220/05* (2013.01); *A63B 2220/833* (2013.01)

(58) Field of Classification Search
CPC ..... A63B 21/4037; A63B 6/00; A63B 6/02
See application file for complete search history.

(56) References Cited

U.S. PATENT DOCUMENTS

| | | | | |
|---|---|---|---|---|
| 4,168,061 | A * | 9/1979 | Gordon | A63B 6/02 482/8 |
| 9,623,278 | B2 * | 4/2017 | Saltzman | A63B 23/03516 |
| 10,315,065 | B1 * | 6/2019 | Soba | A63B 21/151 |
| 2013/0224708 | A1 * | 8/2013 | Martin | G09B 19/00 434/247 |
| 2014/0051531 | A1 * | 2/2014 | Mazzocchi | A63B 6/00 434/247 |
| 2014/0237718 | A1 * | 8/2014 | Burch | A63B 21/4037 5/417 |
| 2017/0177084 | A1 * | 6/2017 | Mangharam | A63B 21/4037 |
| 2017/0340946 | A1 * | 11/2017 | Simon | A63B 21/4037 |
| 2018/0353800 | A1 * | 12/2018 | Calvaruso | A63B 21/4037 |
| 2019/0105546 | A1 * | 4/2019 | Ferrara | A63B 21/4037 |
| 2019/0383347 | A1 * | 12/2019 | Van den Avont | F16F 9/0436 |
| 2023/0001261 | A1 * | 1/2023 | Kang | A63B 21/4037 |
| 2024/0148275 | A1 * | 5/2024 | Mummy | A63B 24/0075 |
| 2024/0207670 | A1 * | 6/2024 | Schultz | A63B 21/4037 |

* cited by examiner

*Primary Examiner* — Zachary T Moore
(74) *Attorney, Agent, or Firm* — Norton Rose Fulbright Canada LLP; Thomas Sutherland

(57) ABSTRACT

According to an aspect, there is provided a workout mat for user alignment and systems to provide alignment feedback using same. The mat includes a top surface that displays an alignment indication including a first set of indications defining alignment regions wherein the indications are proportional oblong shapes in a series of descending size wherein the largest oblong is proximate a medial portion of the mat and the smallest oblong is proximate a lateral portion of the mat, a second set of indications mirroring the first set of indications defining alignment regions, and a medial length oriented region defined in the medial space between the first set of indications and the second set of indications.

20 Claims, 11 Drawing Sheets

ALIGNMENT MAT

FIELD

The systems and methods described herein generally relate to the field of exercise mats and more specifically to the provision of alignment indications and guidance for use of same.

INTRODUCTION

Workout mats can be used for exercise to provide a durable and comfortable surface. Workout mats can be used for different types of exercises such as yoga, stretching, weight training, interval training, and dance, for example.

Conventional workout mats often lack indications suitable for users of differing proportions, heights, or body types (i.e., indications made only for users of a specific default height or body type) or for a variety of different activities (i.e., indications for a specific pose). Furthermore, conventional mats may not have placement indications for widthwise use of the mat. These limitations may further be exacerbated by the use of indications which are difficult to see in low lighting conditions (e.g., dawn, dusk, or in a dimly lit studio) or by those who have mild visual impairment (e.g., those using the mat without prescription eyewear).

Improvement in the indications provided on workout mats is desirable.

SUMMARY

Mats without suitable indications for users of different heights or body types or for differing exercises may have limited application. Furthermore, it is important for these indications to be easily interpretable including in low visibility circumstances (e.g., dawn, dusk, or in a dimly lit studio).

The products, systems, and methods described herein can provide mats that can be more easily visually interpreted, versatile for different user proportions, heights, body types, lighting conditions, and activities/poses. The mats described herein can improve user alignment by allowing the user to appraise their position against the alignment indications on the mat.

The composition of alignment patterns on the mats presented herein may provide sufficient granularity to offer guidance to users of different proportions, heights, or body types, or for a variety of activities while avoiding pitfalls of complex compositions (e.g., difficulty in aligning body parts at opposite ends of the mat, optical grid illusions such as the Lingelback scintillating grid or Hermann grid illusion) thus possibly providing ease of interpretation for the user.

Indications such as those described herein may make use of Gestalt psychology and theories of grouping to provide easily interpretable indications for the user with limited visibility required. In some embodiments, the indications are made up of rounded oblongs of descending size symmetric about a lengthwise center of the mat. Some indications may include central lines/boundaries to support alignment when the mat used widthwise, end portions/boundaries to support alignment when the mat is used lengthwise.

Indication such as those described herein can be advantageous in activities where physical alignment is desirable. The indications may also be used for guidance in multiple activities including yoga, calisthenics, weightlifting, tai chi, qi gong, stretching, aerobic exercises, dancing, training, etc.

According to an aspect, there is provided a workout mat for user alignment comprising a mat having a top surface, a bottom surface, a length, a width, and a depth. The mat top surface displays an alignment indication including a first set of indications defining alignment regions wherein the indications are proportional oblong shapes in a series of descending size wherein the largest oblong is proximate a medial portion of the mat and the smallest oblong is proximate a lateral portion of the mat, and a second set of indications defining alignment regions wherein the indications are proportional oblong shapes in a series of descending size wherein the largest oblong is proximate the medial portion of the mat and the smallest oblong is proximate a lateral portion of the mat. The first set of alignment indications mirrors the second set of indications and a medial length oriented region is defined in the medial space between the first set of indications and the second set of indications.

In some embodiments, the oblong shapes of the first set of indications and the second set of indications each comprise one lengthwise side and two opposing widthwise sides.

In some embodiments, the lengthwise side is parallel to the lengthwise edge of the mat.

In some embodiments, the two opposing widthwise sides define an obtuse angle therebetween.

In some embodiments, the oblong shapes of the first set of indications and the second set of indications have rounded corners.

In some embodiments, the first and the second set of indications defining alignment regions comprise a set of boundary lines.

In some embodiments, the set of boundary lines are of variable weight.

In some embodiments, the first and the second set of indications defining alignment regions comprise at least one of a variation in color, luminosity, pattern, a combination of one or more of color, luminance and pattern.

In some embodiments, the regions are defined by a difference in gradient color and/or luminance wherein the difference comprises a lighter gradient color and/or luminance proximate the medial portion and a darker gradient color and/or luminance proximate a lateral portion.

In some embodiments, the first and the second set of indications defining alignment regions comprise a variation in texture, raised surface, and indented surface.

In some embodiments, the first and the second set of indications defining alignment regions comprise at least one of a variation in color, luminosity, pattern, texture, raised surface, indented surface, and a combination thereof.

In some embodiments, each indication of the first and second sets of indications are spaced equally apart.

In some embodiments, one or more of indications are omitted from the first or second set of indications.

In some embodiments, the first set of alignment regions and the second set of alignment regions each contain 4-10 oblong shapes.

In some embodiments, the first set of alignment regions and the second set of alignment regions each contain 5-9 oblong shapes.

In some embodiments, an imaging device is directed at the mat top surface alignment indication and user position in relationship to the mat top surface alignment indication.

In some embodiments, the imaging device is configured to recognize the first set of indications and second set of indications.

In some embodiments, an imaging device is directed at the mat top surface alignment indication and user position in relationship to the mat top surface alignment indication. The imaging device is configured to recognize the first set of indications and second set of indications.

In some embodiments, the workout mat is further configured to, in conjunction with alignment indications and/or alignment regions, determine user position.

In some embodiments, the workout mat further includes a controller integrated into the mat, a connector, associated with the controller for transmitting data, at least one of an input sensor and an output indicator associated with one or more alignment region, indication defining an alignment region.

In some embodiments, the workout mat further includes at least one sensor input element associated with at least one of the alignment regions.

In some embodiments, the workout mat further includes at least one output indicator to assist a user in alignment and positioning.

In some embodiments, the output indicator comprises at least one of an audio output, a visual output, a tactile output, a thermal output.

In some embodiments, the workout mat further includes a controller integrated into the mat, a connector, associated with the controller for transmitting data, at least one of an input sensor and an output indicator associated with one or more alignment region, indication defining an alignment region. The workout mat further includes at least one sensor input element associated with at least one of the alignment regions. The workout mat further includes at least one output indicator to assist a user in alignment and positioning. The output indicator comprises at least one of an audio output, a visual output, a tactile output, a thermal output.

In some embodiments, one or more corner of the mat is rounded.

In some embodiments, the depth of the mat is formed by a set of layers of more than one type of material.

In some embodiments, a first layer is configured to grip floor surfaces, a second layer is configured for cushioning or stability, and a third layer for one or more of moisture wicking, gripping, and texturing.

In some embodiments, the depth of the mat is formed by a set of layers of more than one type of material. A first layer is configured to grip floor surfaces, a second layer is configured for cushioning or stability, and a third layer for one or more of moisture wicking, gripping, and texturing.

In some embodiments, the mat is fabricated from one or more of polyurethane, polyvinyl butyral, rubber, latex, polyester and nylon, or any suitable natural or synthetic thermoplastic elastomer.

In some embodiments, the alignment indication is formed by one or more screen printing, digital printing, sublimation printing, laser printing, UV printing, engraving, embossing, addition of a raised surface element, cut outs that reveal another surface, additional surfaces applied with an adhesive or heat bonding.

According to an aspect, there is provided a system for user alignment. The system includes a mat, a user alignment or positioning detector configured to detect a user's alignment or positioning, and a computing device. The mat having a top surface, a bottom surface, a length, a width, and a depth The mat top surface displays an alignment indication including a first set of indications defining alignment regions wherein the indications are proportional oblong shapes in a series of descending size wherein the largest oblong is proximate a medial portion of the mat and the smallest oblong is proximate a lateral portion of the mat, a second set of indications defining alignment regions wherein the indications are proportional oblong shapes in a series of descending size wherein the largest oblong is proximate the medial portion of the mat and the smallest oblong is proximate a lateral portion of the mat. The first set of indications mirrors the second set of indications and a medial length oriented region is defined in the medial space between the first set of indications and the second set of indications. The computing device configured to receive the user's alignment or positioning from the user alignment or positioning detector, generate alignment or positioning feedback based on the user's alignment or positioning and user information, and present the alignment or positioning feedback to the user.

In some embodiments, the oblong shapes of the first set of indications and the second set of indications each comprise one lengthwise side and two opposing widthwise sides.

In some embodiments, the lengthwise side is parallel to the lengthwise edge of the mat.

In some embodiments, the two opposing widthwise sides define an obtuse angle therebetween.

In some embodiments, the oblong shapes of the first set of indications and the second set of indications have rounded corners.

In some embodiments, the first and the second set of indications defining alignment regions comprise a set of boundary lines.

In some embodiments, the set of boundary lines are of variable weight.

In some embodiments, the first and the second set of indications defining alignment regions comprise at least one of a variation in color, luminosity, pattern, a combination of one or more of color, luminance and pattern.

In some embodiments, the regions are defined by a difference in gradient color and/or luminance wherein the difference comprises a lighter gradient color and/or luminance proximate the medial portion and a darker gradient color and/or luminance proximate a lateral portion.

In some embodiments, the first and the second set of indications defining alignment regions comprise a variation in texture, raised surface, and indented surface.

In some embodiments, the first and the second set of indications defining alignment regions comprise at least one of a variation in color, luminosity, pattern, a combination of one or more of color, luminance, pattern, texture, raised surface, indented surface, and a combination thereof.

In some embodiments, each indication of the first and second sets of indications are spaced equally apart.

In some embodiments, one or more of indications is omitted from the first or second set of indications.

In some embodiments, the first set of alignment regions and the second set of alignment regions each contain 4-10 oblong shapes.

In some embodiments, the first set of alignment regions and the second set of alignment regions each contain 5-9 oblong shapes.

In some embodiments, the a user alignment or positioning detector includes an imaging device. The imaging device is directed at the mat top surface alignment indication and user position in relationship to the mat top surface alignment indication.

In some embodiments, the imaging device is configured to recognize the first set of indications and second set of indications.

In some embodiments, the a user alignment or positioning detector includes an imaging device. The imaging device is directed at the mat top surface alignment indication and user position in relationship to the mat top surface alignment indication. The imaging device is configured to recognize the first set of indications and second set of indications.

In some embodiments, the system is further configured to, in conjunction with alignment indications and/or alignment regions, determine user position.

In some embodiments, the system also includes a controller integrated into the mat, a connector, associated with the controller for transmitting data, at least one of an input sensor and an output indicator associated with one or more alignment region, indication defining an alignment region.

In some embodiments, the system also includes at least one sensor input element associated with at least one of the alignment regions.

In some embodiments, the system also includes at least one output indicator to assist a user in alignment and positioning.

In some embodiments, the output indicator comprises at least one of an audio output, a visual output, a tactile output, a thermal output.

In some embodiments, the system also includes a controller integrated into the mat, a connector, associated with the controller for transmitting data, at least one of an input sensor and an output indicator associated with one or more alignment region, indication defining an alignment region. The system also includes at least one sensor input element associated with at least one of the alignment regions. The system also includes at least one output indicator to assist a user in alignment and positioning. The output indicator comprises at least one of an audio output, a visual output, a tactile output, a thermal output.

In some embodiments, one or more corner of the mat is rounded.

In some embodiments, the depth of the mat is formed by a set of layers of more than one type of material.

In some embodiments, a first layer is configured to grip floor surfaces, a second layer is configured for cushioning or stability, and a third layer for one or more of moisture wicking, gripping, and texturing.

In some embodiments, the depth of the mat is formed by a set of layers of more than one type of material. A first layer is configured to grip floor surfaces, a second layer is configured for cushioning or stability, and a third layer for one or more of moisture wicking, gripping, and texturing.

In some embodiments, the mat is fabricated from one or more of polyurethane, polyvinyl butyral, rubber, latex, polyester and nylon, or any suitable natural or synthetic thermoplastic elastomer.

In some embodiments, the alignment indication is formed by one or more screen printing, digital printing, sublimation printing, laser printing, UV printing, engraving, embossing, addition of a raised surface element, cut outs that reveal another surface, additional surfaces applied with an adhesive or heat bonding.

According to an aspect, there is provided a workout mat including a top surface, a bottom surface, a length, a width, a depth, and a controller. The mat top surface displays alignment indications including a first set of indications defining alignment regions wherein the indications are proportional oblong shapes in a series of descending size wherein the largest oblong is proximate a medial portion of the mat and the smallest oblong is proximate a lateral portion of the mat, and a second set of indications defining alignment regions wherein the indications are proportional oblong shapes in a series of descending size wherein the largest oblong is proximate the medial portion of the mat and the smallest oblong is proximate a lateral portion of the mat. The first set of indications mirrors the second set of indications and a medial length oriented region is defined in the medial space defined between the first set of indications and the second set of indications, and one or more sensor integrated into the mat and corresponding with one or more alignment indication configured to receive signals from the user. The controller integrated into the mat configured to receive signals from the one or more sensor, and transmit the signals to a computing device.

In some embodiments, the oblong shapes of the first set of indications and the second set of indications each comprise one lengthwise side and two opposing widthwise sides.

In some embodiments, the lengthwise side is parallel to the lengthwise edge of the mat.

In some embodiments, the two opposing widthwise sides define an obtuse angle therebetween.

In some embodiments, the oblong shapes of the first set of indications and the second set of indications have rounded corners.

In some embodiments, the first and the second set of indications defining alignment regions comprise a set of boundary lines.

In some embodiments, the set of boundary lines are of variable weight.

In some embodiments, the first and the second set of indications defining alignment regions comprise at least one of a variation in color, luminosity, pattern, a combination of one or more of color, luminance and pattern.

In some embodiments, the regions are defined by a difference in gradient color and/or luminance wherein the difference comprises a lighter gradient color and/or luminance proximate the medial portion and a darker gradient color and/or luminance proximate a lateral portion.

In some embodiments, the first and the second set of indications defining alignment regions comprise a variation in texture, raised surface, and indented surface.

In some embodiments, the first and the second set of indications defining alignment regions comprise at least one of a variation in color, luminosity, pattern, a combination of one or more of color, luminance, pattern, texture, raised surface, indented surface, and a combination thereof.

In some embodiments, each indication of the first and second sets of indications are spaced equally apart.

In some embodiments, one or more of indications is omitted from the first or second set of indications.

In some embodiments, the first set of alignment regions and the second set of alignment regions each contain 4-10 oblong shapes.

In some embodiments, the first set of alignment regions and the second set of alignment regions each contain 5-9 oblong shapes.

In some embodiments, an imaging device is directed at the mat top surface alignment indication and user position in relationship to the mat top surface alignment indication.

In some embodiments, the imaging device is configured to recognize the first set of indications and second set of indications.

In some embodiments, an imaging device is directed at the mat top surface alignment indication and user position in relationship to the mat top surface alignment indication. The imaging device is configured to recognize the first set of indications and second set of indications.

In some embodiments, the mat is further configured to, in conjunction with alignment indications and/or alignment regions, determine user position.

In some embodiments, the mat further includes at least one output indicator to assist a user in alignment and positioning.

In some embodiments, the output indicator comprises at least one of an audio output, a visual output, a tactile output, a thermal output.

In some embodiments, one or more corner of the mat is rounded.

In some embodiments, the depth of the mat is formed by a set of layers of more than one type of material.

In some embodiments, a first layer is configured to grip floor surfaces, a second layer is configured for cushioning or stability, and a third layer for one or more of moisture wicking, gripping, and texturing.

In some embodiments, the depth of the mat is formed by a set of layers of more than one type of material. A first layer is configured to grip floor surfaces, a second layer is configured for cushioning or stability, and a third layer for one or more of moisture wicking, gripping, and texturing.

In some embodiments, the mat is fabricated from one or more of polyurethane, polyvinyl butyral, rubber, latex, polyester and nylon, or any suitable natural or synthetic thermoplastic elastomer.

In some embodiments, the alignment indication is formed by one or more screen printing, digital printing, sublimation printing, laser printing, UV printing, engraving, embossing, addition of a raised surface element, cut outs that reveal another surface, additional surfaces applied with an adhesive or heat bonding.

Many further features and combinations thereof concerning embodiments described herein will appear to those skilled in the art following a reading of the instant disclosure.

DESCRIPTION OF THE FIGURES

In the figures.

DETAILED DESCRIPTION

Figure 1A:
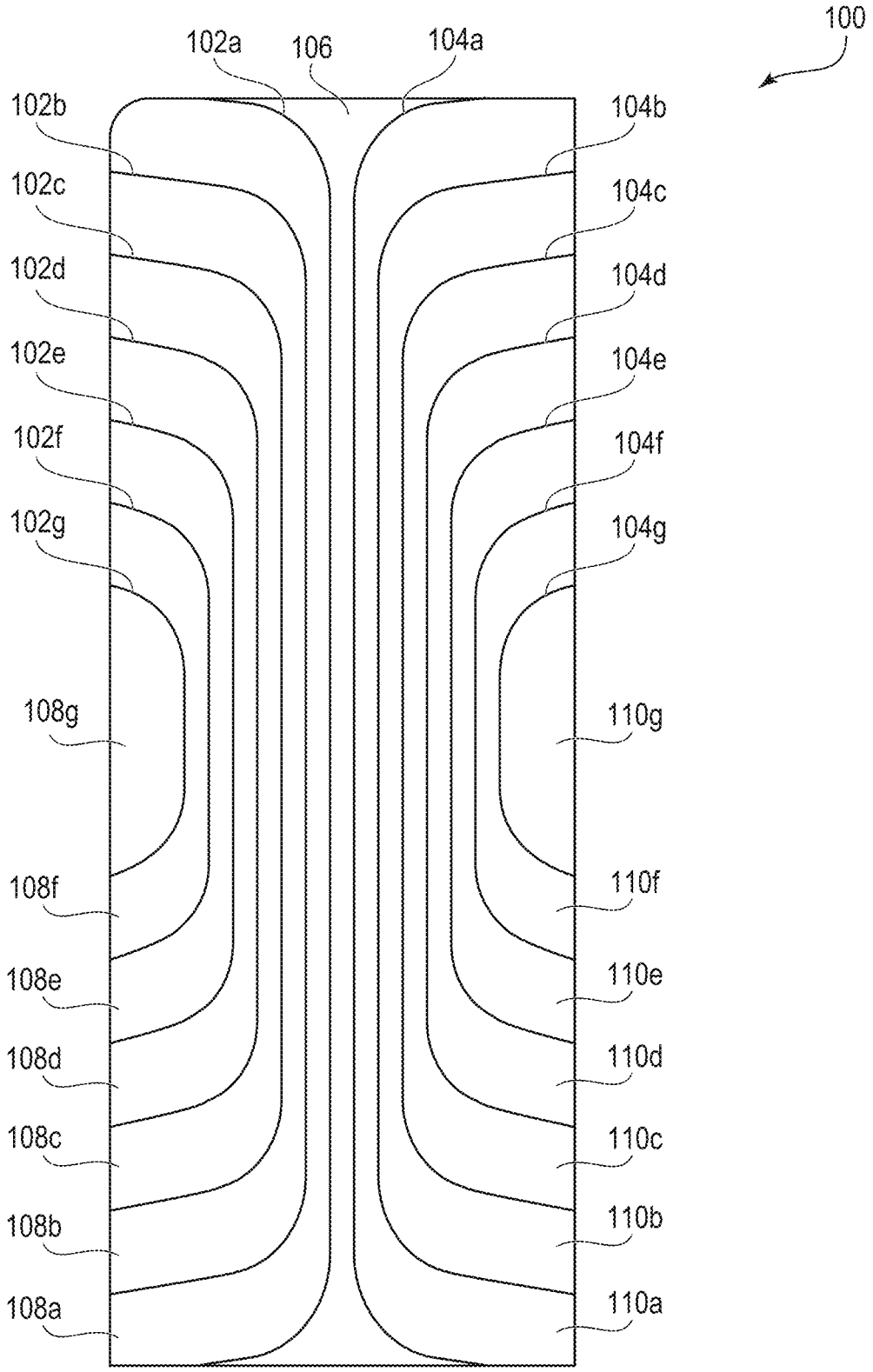
FIG. 1A illustrates a top view of an example alignment pattern, according to some embodiments.

Embodiments described herein relate to a workout mat to provide alignment indications and/or guidance to a user.

In an aspect, embodiments described herein provide a workout mat to enhance alignment, for example, when performing a physical activity. The user's alignment and/or positioning data can be received (from an imager or a workout mat sensor) and assessed. Feedback can be generated with reference to alignment indications can be provided to assist the user in their alignment and positioning.

Mat Alignment

Alignment guidance indications may be carefully prepared to ensure ease of visual interpretation by the user from a standing position. Providing too few indications may not be sufficiently adaptable for a variety of activities or may require assumptions about body proportions (thus limiting the mat's utility for a wide variety of proportions, heights, and body types). Providing too many indications on a mat may make the mat difficult to interpret (e.g., from the standing position or in low lighting conditions). Indications which are easily visually interpretable for the user are essential for many activities because if the user is unable to ascertain their alignment easily they may not use the mat at all for alignment (defeating the purpose of the alignment indications) or they may need to inspect the mat closely to understand their alignment (interrupting the activity, pose, or exercise and distracting the user).

The solution may be to provide indications which focus on alignment rather than on specific activities or specific proportions, heights, and body types. Providing indications with multiple elements that assist a user to quickly and easily visually identify and differentiate different alignment regions can enable a greater number of indications to be included without overwhelming the user and rendering the composition difficult to parse (too dense or exhibiting grid illusions).

Indications such as those described herein may make use of Gestalt psychology and theories of grouping to provide easily interpretable markings for the user with limited visibility required. In some embodiments, indications are made up of rounded oblongs of descending sizes symmetric about a lengthwise center of the mat. Some indications may include central lines/boundaries to support alignment when the mat used widthwise, and end portions/boundaries to support alignment when the mat is used lengthwise.

The products, systems, and methods described herein can provide mats that can be easily visually interpreted. They can be versatile for different user proportions, heights, or body types, and activities/poses by virtue of a plurality of indications that are visually interpretable by the user. The mats described herein can improve user alignment by allowing the user to appraise their position against the alignment indications on the mat.

Indications such as those described herein can be advantageous in activities where physical alignment is desirable. The indications may also be used for guidance in multiple activities including yoga, calisthenics, weightlifting, tai chi, qi gong, stretching, aerobic exercises, dancing, training, etc. Many other activities are also conceived.

FIG. 1A illustrates a top view of an example alignment pattern, according to some embodiments.

Mat 100 provides an illustration of an example alignment pattern making use of symmetric rounded oblongs. The mat

100 comprises a first set of indications 102 (i.e., indications 102 inclusive of 102*a*-102*g*) and a second set of indications 104 (i.e., indications 104 inclusive of 104*a*-104*g*). These indications are symmetric about the plane passing through the lengthwise center of the mat 100 and may exhibit the same, but mirrored properties. Each indication 102 and 104 is made of oblong shapes with one side approximately parallel to the lengthwise edges of the mat 100 and two opposing sides approximately parallel to the widthwise edges of the mat 100. The indications 102 and 104 may decrease in size from the indication with a side closest to the lengthwise center (e.g., indication 102*a* and 104*a*) to the indication with a lengthwise side closes to the edge (e.g., indication 102*g* and 104*g*). Indications 102 and 104 may define a plurality of alignment regions such as central alignment region 106 between indications 102*a* and 104*a*, a first set of alignment regions 108 (i.e., alignment regions 108 inclusive of 108*a*-108*g*) between the first set of indications 102, and a second set of alignment regions 110 (i.e., alignment regions 110 inclusive of 110*a*-110*g*) between the second set of indications 104.

The indications may decrease in size such that they are spaced apart by approximately equal distances. In some embodiments, the distance between the lengthwise sides and widthwise sides are approximately equal. In some embodiments such as those illustrated in FIG. 1A the distances between the lengthwise sides and the distanced between the widthwise sides may differ (for example in FIG. 1A the distances between the lengthwise sides of 102*a*-102*g* are approximately equal to each other, but differ from the distances between the approximately equal widthwise sides).

Oblong shapes of the above description enable the user to easily identify the same or corresponding indications 102 and 104 based not only on the distance of the lengthwise sides from the center, but also by following the indications 102 and 104 from their corresponding widthwise edge. For example, if a user is aligning their feet in a wide stance with the lengthwise side of indication 104*c*, it may be easier for the user to identify this indication as the shape that is second from the top and bottom and use that to align their feet rather than aligning one foot and following the indication through the lengthwise region of mat 100. The indications 102 and 104 can be advantageous over grid designs because grid designs have no association between the lengthwise indications and the widthwise indications which may make some alignment orientations more challenging for a user to determine.

By mirroring the indications 102 with 104 the mat 100 is also able to provide easy correspondence across the mat 100 to enable the user to offset a stance or activity appropriately. For example, if an activity calls for the user's heels to be offset from the center by some distance, but on opposite sides of the center of the mat 100, then the user can identify, for example indication 104*d* as the third from the top indication for their first foot and the corresponding indication 102*d* as the third from the bottom indication for their other foot.

The general design of the mat 100 is able to provide the user with a large amount of visual guidance which can be interpreted from a distance, in low lighting, and/or with mild visual impairment (e.g., not wearing prescription eyewear). Furthermore, in avoiding grid style indications, the effect of grid optical illusions can be mitigated or outright avoided. As such, a greater number of indications can be included on mat 100 without causing issues for the user's interpretability. For example, in FIG. 1A, each set of indications 102 and 104 comprises 7 oblong shapes each. Other amounts of indications are also possible such as 5-9 oblong shapes in each set (for a total of 10-18 oblong shapes) or 4-10 oblong shapes in each set (for a total of 8-20 oblong shapes).

In some embodiments, the indications may be rectangular. In some embodiments, the indications can be circular or oval. In some embodiments such as in FIG. 1A, the indications may have rounded corners that taper from their lengthwise side to their widthwise sides. Rounded corners may make the widthwise sides of the indications more readily associated with the lengthwise side of the indications and thereby improve readability at a glance while also retaining large regions of the indications which can be parallel with each other.

In some embodiments, the indications may be perfectly parallel to the lengthwise and widthwise edges of mat 100. In some embodiments, the indications may not be perfectly parallel to either (or both) of the lengthwise or widthwise edges of the mat 100. For example, in FIG. 1A, the sides of the indications generally parallel to the widthwise edges of mat 100 actually have a slightly more obtuse angle when compared with the dimensions of the mat 100. This angle can, for example, more easily enable natural stance alignment because the feet have a somewhat outward angle when the user is facing either lengthwise edge.

In some embodiments, the lines making up each of the indications 102 and 104 may be the same line weight (i.e., thickness). For example, all line thicknesses may be 2 mm. In some embodiments, the lines making up each of the indications 102 and 104 may be of different line weights. In some embodiments, the indications 102 and 104 may make up a pattern of alternating light and heavy line weights. In some embodiments, the line weights may descend down a gradient down each of the sets of indications 102 and 104. For example, the lines making up indications 102*a* and 104*a* may be the heaviest line weights (i.e., the thickest lines) decreasing to indications 102*g* and 104*g* with the lightest line weights (i.e., the narrowest lines). As another example, the lines making up indications 102*g* and 104*g* may be the heaviest line weights (i.e., the thickest lines) decreasing to indications 102*a* and 104*a* with the lightest line weights (i.e., the narrowest lines). Providing line weights that vary over the range of indications 102*a* and 104*a* to 102*g* and 104*g* may provide the user with yet another visual element to aid their eye to visually interpret the mat 100 in varied use conditions.

Figure 1D:
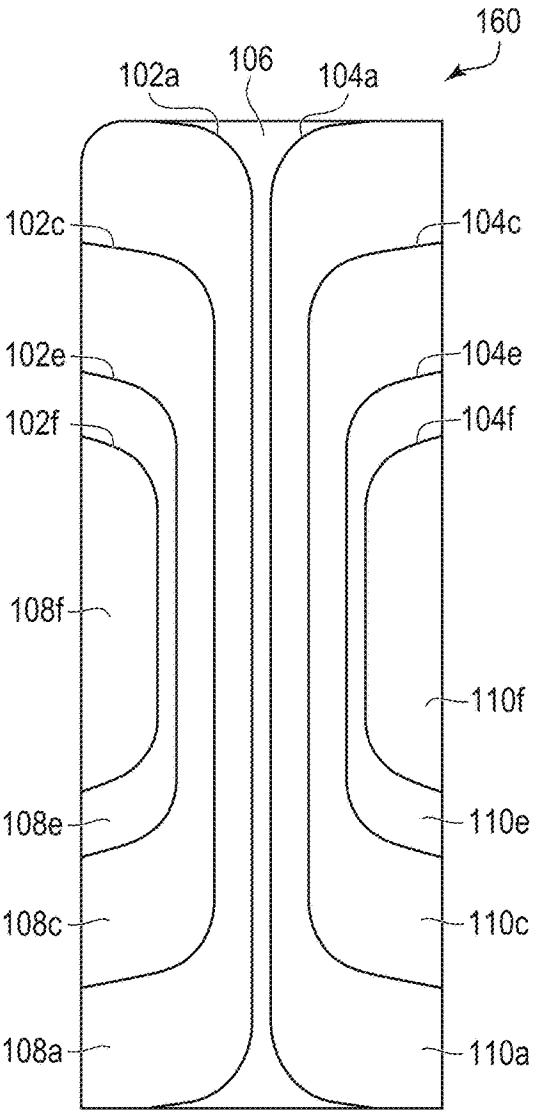
FIG. 1D illustrates a top view of an example alignment pattern with fewer alignment indications, according to some embodiments.
Figure 1C:
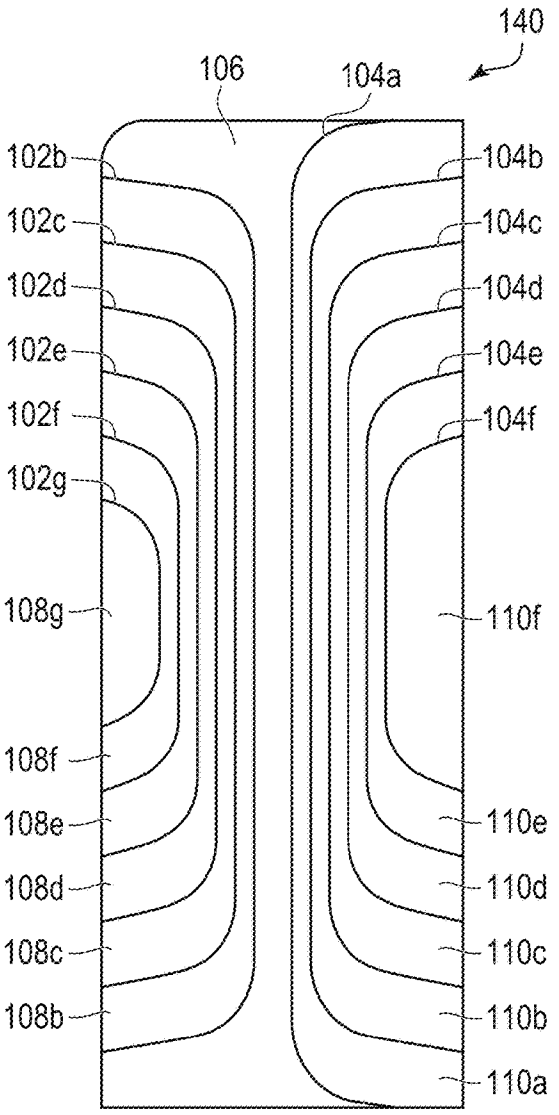
FIG. 1C illustrates a top view of an example alignment pattern where only some indications are mirrored, according to some embodiments.
Figure 1B:
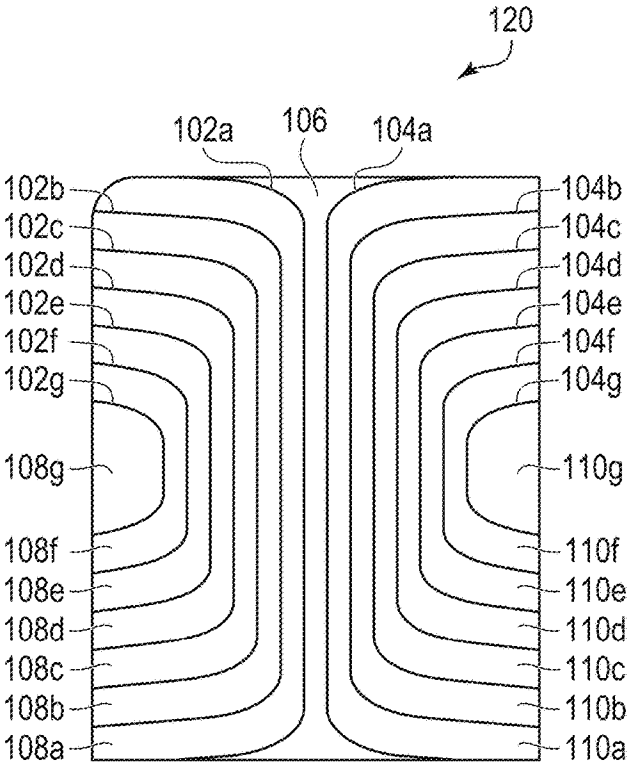
FIG. 1B illustrates a top view of another example alignment pattern for certain activities, according to some embodiments.

FIG. 1B illustrates a top view of another example alignment pattern for certain activities, according to some embodiments.

In comparison with the mat 100 of FIG. 1A, the mat 120 of FIG. 1B is shorter and wider. The internal indications 102 and 104 and alignment regions 106, 108, and 110 have been adjusted to adapt to the different proportions. Different mats with different proportions may be more suited to different activities. For example, the longer and slender mat 100 of FIG. 1A may be well suited for yoga or other such activities. As another example, the shorter and wider mat 120 of FIG. 1B may be more well suited to weightlifting activities (e.g., to align the feet prior to doing squats, deadlifts, or other such variations).

FIG. 1C illustrates a top view of an example alignment pattern where only some indications are mirrored, according to some embodiments.

In comparison with the mat 100 of FIG. 1A, the mat 140 of FIG. 1C is missing indications 102*a* and 104*g*. This produces a mat 140 with substantially mirrored indications 102 and 104 with substantially mirrored alignment regions 106, 108, and 110 except one missing one. Such mats 140 may be suitable where the intended use of the mat 140 may be asymmetric. Other suitable uses may be to provide differential guidance indications on specific sides of the mat 140 without generating too much visual noise on the mat.

FIG. 1D illustrates a top view of an example alignment pattern with fewer alignment indications, according to some embodiments.

In comparison with the mat 100 of FIG. 1A, the mat 160 of FIG. 1C is missing indications 102*b*, 102*d*, 102*g*, 104*b*, 104*d* and 104*g*. This produces a mat 160 with fewer alignment regions (specifically missing alignment regions 108*b*, 108*d*, 108*g*, 110*b*, 110*d*, and 110*g*). This may be suitable to decrease the visual noise on the mat 160. This may be suitable for activities which may not need as many indications 102 or 104. The specific indications that are removed may vary based on the intended activity and/or on the proportions of the user.

Figure 2:
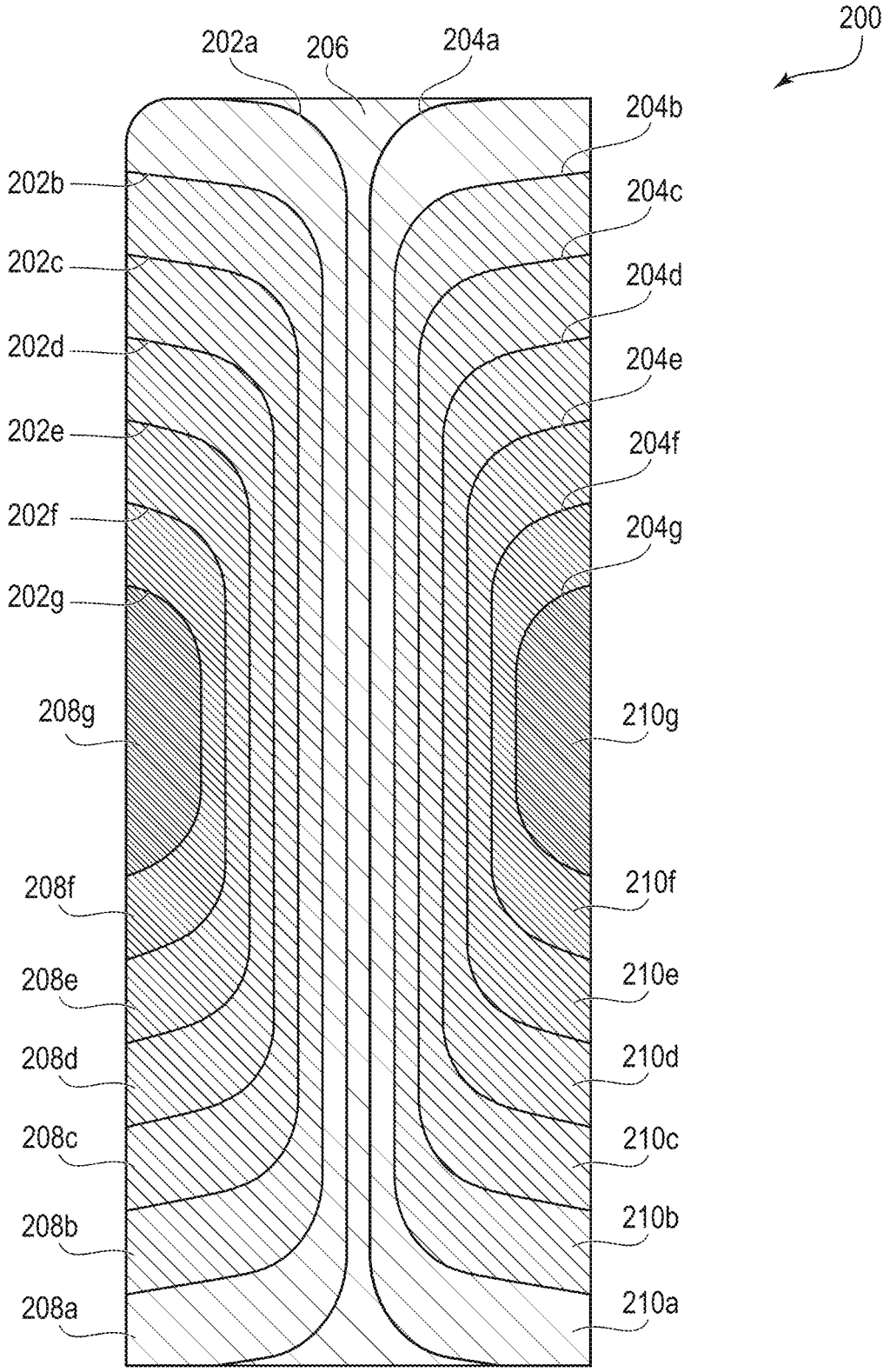
FIG. 2 illustrates a top view of another example alignment pattern, according to some embodiments.

FIG. 2 illustrates a top view of another example alignment pattern, according to some embodiments.

Mat 200 comprises a first set of indications 202 (i.e., indications 202 inclusive of 202*a*-202*g*), a second set of indications 204 (i.e., indications 204 inclusive of 204*a*-204*g*), a central alignment region 206, a first set of alignment regions 208 (i.e., alignment regions 208 inclusive of 208*a*-208*g*), and a second set of alignment regions 210 (i.e., alignment regions 210 inclusive of 210*a*-210*g*) all sharing general variations and properties as described in reference to the elements of the same name in FIG. 1A.

FIG. 2 illustrates an example embodiment wherein colour is varied between the different alignment regions 206, 208, and 210. In particular, the mat 200 may use a lighter colour in the central alignment region 206, and decrease the luminance (i.e., the perceived brightness) of that colour from alignment region 208*a* and 210*a* to 208*g* and 210*g* respectively. The lighter center to darker lateral region may work well in various lighting conditions (e.g., dusk, dawn, dim lighting, etc.) and with mild visual impairment (e.g., a user not wearing their prescription eyewear). In some embodiments, the central region 206 can make use of the highest luminance colour as likely to be near the center of focus and visual acuity. In some embodiments, the central alignment region 206 is the darkest luminance and the alignment regions increase to the highest luminance in alignment regions 208*g* and 210*g*. In some embodiments, other visual properties can be varied such as hue, saturation, and value in an HSV scheme or amount of red, green, or blue in an RGB scheme. In some embodiments, the alignment regions 206, 208, and 210 alternate colour or vary colour drastically (e.g., move from red in the central alignment region 206 through the other colours in the rainbow in alignment regions 208 and 210).

In some embodiments, the luminance (or other visual property) may decrease by a consistent amount between adjacent alignment regions 206, 208, and 210. In some embodiments, the luminance may decrease by varied amounts to maximize the user's visual acuity to the differences between these alignment regions 206, 208, and 210.

In some embodiments, the alignment regions 208 match the colouring on corresponding alignment regions 210. In some embodiments, the alignment regions 208 and 210 do not match. In some embodiments, the central alignment region 206 has an initial colour and alignment regions 208 vary by some colour element (e.g., amount of red in a red, blue, green colour scheme) while alignment regions 210 vary by another colour element (e.g., amount of green) to generate a corresponding, but distinct pattern of variation across the alignment regions 208 and 210.

In some embodiments, the alignment regions 206, 208, and 210 make use of patterns instead of a colour. In some embodiments, the pattern itself changes between adjacent alignment regions (e.g., stripes rotating their orientation or small dots increasing in density based on the alignment region). In some embodiments, a combination of pattern and colour variation can be used (e.g., black dots on a light colour in the central alignment region 206 that increase their density and lower the luminescence of the colour towards alignment regions 208*g* and 210*g*).

In some embodiments, the central alignment regions 206 and first and second alignment regions 208 and 210 may make use of another form of stimulus to differentiate the regions. These embodiments may make use of the other form of stimulus at the exclusion of the visual stimulus or in addition to the visual stimulus (e.g., the colour variations or indications). In some embodiments, the tactile surface may vary based on the alignment region. For example, the central alignment region 206 may be smooth and each adjacent alignment region 208 and 210 is progressively rougher.

In some embodiments, the indications may form a visual diamond type medial alignment region based on the proximity of the lengthwise lines making up each of the indications. For example, in 100, 102 and 104 lengthwise lines adjacent 106 central alignment region may be positioned near to each other such that visually a user can quickly look at the mat and see a defined central diamond type shape. For example, in 200 202 and 204 lengthwise visual differentiation associated with portions of alignment regions adjacent 206 central alignment region may be positioned near to each other such that visually a user can quickly look at the mat and see a defined central diamond type shape. For a user, determining a central location on the mat assists in overall alignment when using the mat. Tactile, heat, or other methods of representing the alignment regions may form this diamond type medial alignment region. Defining the central region in this manner, to provide a diamond type medial alignment region may offer additional alignment advantages to the user of the mat.

Figure 3:
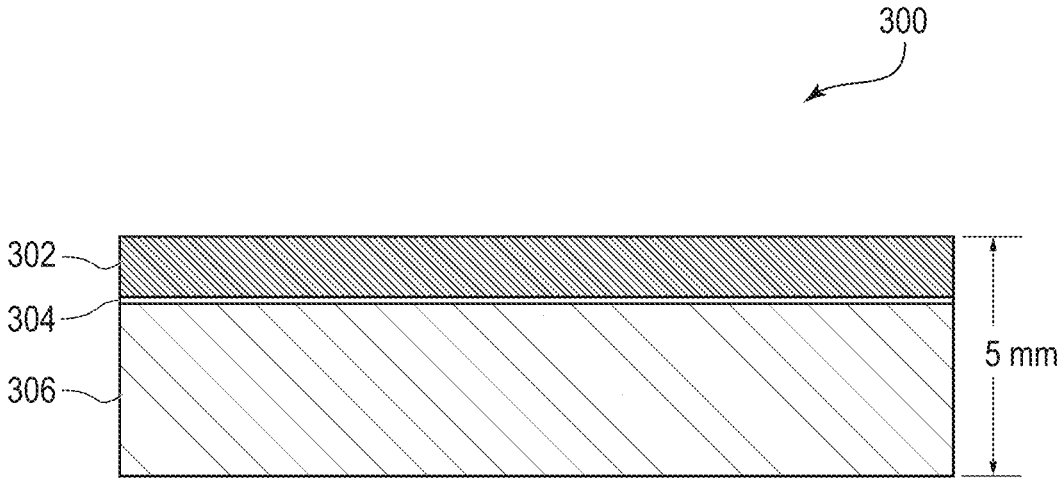
FIG. 3 illustrates cross section of an example mat, according to some embodiments.

FIG. 3 illustrates cross section of an example mat 300, according to some embodiments.

In some embodiments, the mat 300 has more than one layer. In some embodiments, there may be a top layer 302 and a base layer 306. The top layer 302 may include the indications and alignment regions disposed visible to the user and may further be configured with beneficial properties (e.g., non-slip during use, resistant to sweat, moisture wicking, textured features, etc.). The base layer 306 may comprise beneficial properties (e.g., non-slip on floor, cushioning). In some embodiments, one or both of the top layer 302 and the base layer 306 can be interchangeable. In some embodiments, there may be a middle layer 304 disposed therebetween. The middle layer 304 may be configured to provide some of the beneficial properties of the top layer 302 or the base layer 306. The middle layer 304 may also be may be configured to bind the top layer 302 and the base layer 306.

In some embodiments one or more of the top layer 302, the middle layer 304, and base layer 306 are formed from polyurethane (PU), recycled polyvinyl butyral (PVB), rubber, latex, thermoplastic elastomer (TPE), fabric skrim, or a combination. In some embodiments, the top layer 302 comprises polyvinyl butyral, the middle layer 304 comprises a fabric skrim, and the base layer 306 comprises lightweight TPE.

In some embodiments, the mat 300 may be configured to be lightweight and/or rollable. In some embodiments the mat 300 may be around 5 mm thick.

In some embodiments, the mat has a plurality of layers comprising an alignment pattern layer (including indications and alignment regions), non-slip textile/rubber mat surface layer, a multi-zone a sensor layer, a mat layer. In some embodiments the alignment pattern is printed on, embedded, cut or burned into the non-slip textile/rubber mat surface layer. In some embodiments, the mat includes input or output components (described in greater detail below).

Patterns on the top layer 302 (such as indications 102, 104, 202, and 204) can be created using a number of techniques such as printing (screen, digital, sublimation, laser printing, UV, etc.), engraving, embossing, cut outs that reveal another surface, additional surfaces applied with an adhesive or other means.

In some embodiments, the mats can be configured for use in a connected alignment system (e.g., one which detects user positioning and provides feedback to the user or uses the information for other purposes). Such devices are described in greater exemplary detail below, but the features described in this section may be used with many alignment systems.

In particular, the features which make the indications easily interpretable by the user may also be used by a system to better assess user performance (e.g., the indications can improve machine vision of the mat and hence the assessment of user alignment/position). The features that distinguish the alignment regions may also be used by any such system to provide detailed feedback to the user (e.g., rather than suggesting the user move their stance in by 2 inches, it could instruct the user to move their foot to the next alignment region).

In some embodiments, an imagining device may be configured to detect the indications on the mat and assess the user alignment and/or positioning (e.g., inclusive of movements, based on a target alignment position) based on the indications. In some embodiments, such systems have been configured with the indication patterning in advance to assist the user. In some embodiments, the system is capable of recognizing and assessing user alignment and/or positioning on indications that the system has not seen before. The system may be further configured to use this determination to provide feedback to the user using the positioning and/or patterns of alignment associated with the indications. In some embodiments, the system may be configured to use this determination to provide feedback such as a visual guide to the user or instructions to improve their alignment and/or positioning. In some embodiments, the system uses the determination to score or otherwise assess user performance.

In some embodiments, input sensors may be built directly into the mat which are associated with the indications and the alignment regions (described in greater detail below). In some embodiments, the mat may have outputs built into the mat directly, such as to provide a output such as heating, cooling, vibration, haptics, sound, airflow, lighting, digital interface, smell, and surface material changes to assist the user in alignment and/or positioning.

Referring to FIG. 1A, according to an aspect, there is provided a workout mat 100 for user alignment comprising a mat 100 having a top surface, a bottom surface, a length, a width, and a depth. The mat top surface displays an alignment indication including a first set of indications 102 defining alignment regions 108 wherein the indications 102 are proportional oblong shapes in a series of descending size wherein the largest oblong 102*a* is proximate a medial portion of the mat 100 and the smallest oblong 102*g* is proximate a lateral portion of the mat 100, and a second set of indications 104 defining alignment regions 110 wherein the indications 104 are proportional oblong shapes in a series of descending size wherein the largest oblong 104*a* is proximate the medial portion of the mat 100 and the smallest oblong 104*g* is proximate a lateral portion of the mat 100. The first set of indications 102 mirrors the second set of indications 104 and a medial length oriented region 106 is defined in the medial space between the first set of indications 102 and the second set of indications 104.

In some embodiments, the oblong shapes of the first set of indications 102 and the second set of indications 104 each comprise one lengthwise side and two opposing widthwise sides.

In some embodiments, the lengthwise side is parallel to the lengthwise edge of the mat 100.

In some embodiments, the two opposing widthwise sides define an obtuse angle therebetween.

In some embodiments, the oblong shapes of the first set of indications 102 and the second set of indications 104 have rounded corners.

In some embodiments, the first and the second set of indications 102 and 104 defining alignment regions comprise a set of boundary lines.

In some embodiments, the set of boundary lines are of variable weight.

In some embodiments, the first and the second set of indications 102 and 104 defining alignment regions 106, 108, and 110 comprise at least one of a variation in color, luminosity, pattern, a combination of one or more of color, luminance and pattern.

In some embodiments, the regions 106, 108, and 110 are defined by a difference in gradient color and/or luminance wherein the difference comprises a lighter gradient color and/or luminance proximate the medial portion and a darker gradient color and/or luminance proximate a lateral portion.

In some embodiments, the first and the second set of indications 102 and 104 defining alignment regions 108 and 110 comprise a variation in texture, raised surface, and indented surface.

In some embodiments, the first and the second set of indications 102 and 104 defining alignment regions 106, 108, and 110 comprise at least one of a variation in color, luminosity, pattern, texture, raised surface, indented surface, and a combination thereof.

In some embodiments, each indication of the first and second sets of indications 102 and 104 are spaced equally apart.

In some embodiments, one or more of alignment region 106, 108, and 110 is omitted from the first or second set of indications 102 and 104. In some embodiments, the mat only comprises one set of indications 102 that extend across the full width of the mat 100.

In some embodiments, the first set of alignment regions 108 and the second set of alignment regions 110 each contain 4-10 oblong shapes.

In some embodiments, the first set of alignment regions 108 and the second set of alignment regions 110 each contain 5-9 oblong shapes.

In some embodiments, an imaging device (e.g., 404 described below) is directed at the mat top surface alignment indication and user position in relationship to the mat top surface alignment indication.

In some embodiments, the imaging device (e.g., 404 described below) is configured to recognize the first set of indications 102 and second set of indications 104.

In some embodiments, an imaging device (e.g., 404 described below) is directed at the mat top surface alignment indication and user position in relationship to the mat top surface alignment indication. The imaging device (e.g., 404 described below) is configured to recognize the first set of indications 102 and second set of indications 104.

In some embodiments, the workout mat 100 is further configured to, in conjunction with alignment indications 102 and 104 and/or alignment regions 106, 108, and 110, determine user position.

In some embodiments, the workout mat 100 further includes a controller integrated into the mat, a connector, associated with the controller for transmitting data, at least one of an input sensor and an output indicator associated with one or more alignment region 106, 108, and 110, indication defining an alignment region.

In some embodiments, the workout mat 100 further includes at least one sensor input element associated with at least one of the alignment regions 106, 108, and 110.

In some embodiments, the workout mat 100 further includes at least one output indicator to assist a user in alignment and positioning.

In some embodiments, the output indicator comprises at least one of an audio output, a visual output, a tactile output, a thermal output.

In some embodiments, the workout mat 100 further includes a controller integrated into the mat, a connector, associated with the controller for transmitting data, at least one of an input sensor and an output indicator associated with one or more alignment region 106, 108, and 110, indication defining an alignment region. The workout mat 100 further includes at least one sensor input element associated with at least one of the alignment regions 106, 108, and 110. The workout mat 100 further includes at least one output indicator to assist a user in alignment and positioning. The output indicator comprises at least one of an audio output, a visual output, a tactile output, a thermal output.

In some embodiments, one or more corner of the mat 100 is rounded.

In some embodiments, the depth of the mat 100 is formed by a set of layers of more than one type of material.

In some embodiments, a first layer is configured to grip floor surfaces, a second layer is configured for cushioning or stability, and a third layer for one or more of moisture wicking, gripping, and texturing.

In some embodiments, the depth of the mat 100 is formed by a set of layers of more than one type of material. A first layer is configured to grip floor surfaces, a second layer is configured for cushioning or stability, and a third layer for one or more of moisture wicking, gripping, and texturing.

In some embodiments, the mat 100 is fabricated from one or more of polyurethane, polyvinyl butyral, rubber, latex, polyester and nylon or any suitable natural or synthetic thermoplastic elastomer. In some embodiments, the mat 100 is fabricated from at least one of 5% polyester and 5% nylon.

In some embodiments, the alignment indication 102 and 104 is formed by one or more screen printing, digital printing, sublimation printing, laser printing, UV printing, engraving, embossing, addition of a raised surface element, cut outs that reveal another surface, additional surfaces applied with an adhesive or heat bonding.

Non-Connected Mats in Integrated Feedback Systems

In some embodiments, the mat may be configured to interoperate with a system to provide the user with feedback based on their alignment and/or position on the mat using the alignment pattern. In such embodiments, the system may be configured to determine the user alignment position and compare it to a target alignment position (based on for example a guidance routine and a user's proportions height and/or body type), and provide the user with feedback based on indications and alignment regions present on the alignment pattern. In some embodiments, such data may be acquired using, for example, an imager configured to monitor the user and the mat.

Figure 4:
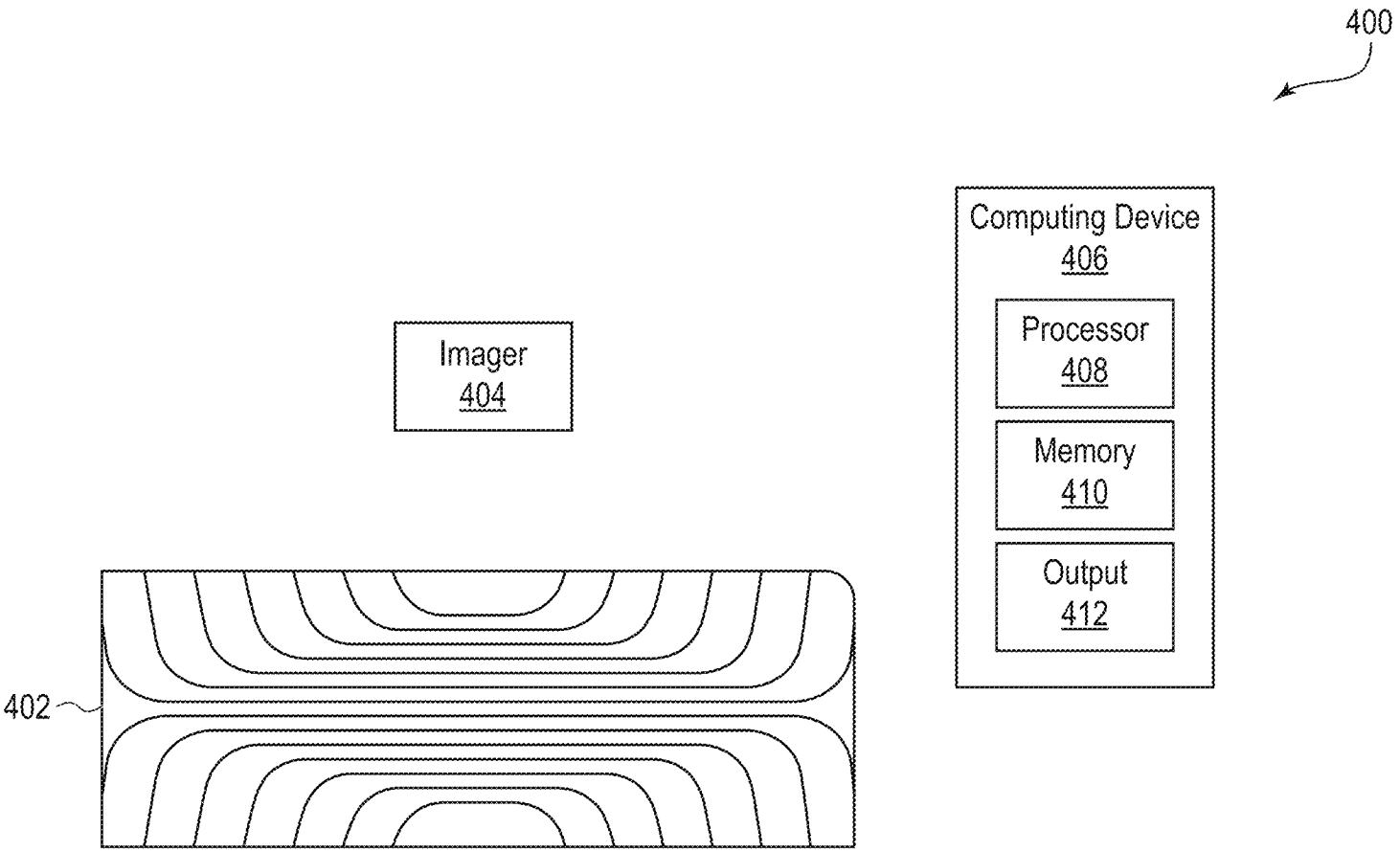
FIG. 4 illustrates an example system for receiving information on the user's alignment and/or position on a mat, according to some embodiments.

FIG. 4 illustrates an example system 400 for receiving information on the user's alignment and/or position on a mat 402, according to some embodiments.

The system 400 comprises a mat 402 with the alignment pattern printed thereon, an imager 404, and a computing device 406. The system may be configured to determine user alignment and/or positioning from images taken by imager 404 and assess the user's performance (e.g., by comparing the user alignment position with the target alignment position—such alignment positions may include movements) and provide feedback based on indications and alignment regions on the mat 402 using the computing device 406.

In some embodiments, the mat 402 may comprise indications and alignment regions as described above with reference to FIG. 1A-1D and FIG. 2. In some embodiments, the mat 402 may also comprise alignment elements not described above, but with which the system may be capable of receiving information on and providing feedback in reference to.

The imager 404 may be a camera device configured to record images of the mat 402 and the user's alignment and/or position thereon. The imager 404 may be a specific imager device configured for these described uses. The imager 404 may be part of a device available to the user (e.g., the user's camera on their mobile phone). The imager 404 may be integrated as part of another device such as a digital content platform configured to provide output to the user. Though illustrated as a separate device, imager 404 may be a component of the computing device 406 (e.g., if the user's device acts as the computing device 406).

The computing device 406 may comprise processor 408, memory 410, and an output 412. The computing device 406 may be configured to receive the image data from imager 404, process the image data to determine user alignment and/or positioning on the mat 402, and generate feedback for the user. Processing the image data may comprise processing indications and alignment regions on mat 402 and the user's alignment and/or positioning and relative to these indications and alignment regions. The feedback generated may also comprise feedback to the user that uses the indications and alignment regions of mat 402 to provide feedback to the user (e.g., giving instruction to the user in reference to the indications and alignment regions). The computing device 406 may receive inputs from external devices and/or servers. For example, computing device 406 may comprise a digital content platform which can be configured to provide instructions for a series of activities to the user. In such embodiments, the computing device 406 may receive real-time instruction from a remote instructor. Further, the computing device 406 may receive data stored in a remote server such as a series of activities to be provided to the user, method of processing images or user information, feedback generation protocols, etc.

The processor 408 may be configured to process the images, determine user alignment and/or positioning, for example, relative to indications and/or alignment regions of the mat 402, generate feedback for the user, for example, based on the indications or alignment regions, and present or transmit the feedback for presentation. The processor 408 may be, for example, any type of general-purpose microprocessor or microcontroller, a digital signal processing (DSP) processor, an integrated circuit, a field programmable gate array (FPGA), a reconfigurable processor, a programmable read-only memory (PROM), or any combination thereof.

The memory 410 may comprise machine readable instructions which when executed instruct the processor to process the images, determine the user alignment and/or positioning, generate feedback, and/or present or transmit the feedback for presentation. The memory 410 may further be configured to store data applicable to the above functions such as, for example, user profiles, position patterns, etc. The memory 410 may include a suitable combination of any type of computer memory that is located either internally or externally such as, for example, random-access memory (RAM), read-only memory (ROM), compact disc read-only memory (CDROM), electro-optical memory, magneto-optical memory, erasable programmable read-only memory (EPROM), and electrically-erasable programmable read-only memory (EEPROM), Ferroelectric RAM (FRAM) or the like.

The output 412 can provide the user with feedback to assist them in aligning and/or positioning their body on the mat 402, for example, using indications or alignment regions on the mat 402. The feedback may be in the form of audio or visual instruction. The feedback may also provide other stimulus (e.g., providing feedback on assessment of the user alignment and/or positioning).

A network interface (not shown) enables the computing device 406 to receive input or transmit data to, for example, external servers (e.g., to upload user performance or download processing algorithms) or external instructor devices (e.g., during the provision of a live instructor session). The network interface enables computing device 406 to communicate with other components, to exchange data with other components, to access and connect to network resources, to serve applications, and perform other computing applications by connecting to a network (or multiple networks) capable of carrying data including the Internet, Ethernet, plain old telephone service (POTS) line, public switch telephone network (PSTN), integrated services digital network (ISDN), digital subscriber line (DSL), coaxial cable, fiber optics, satellite, mobile, wireless (e.g. Wi-Fi, WiMAX), SS7 signaling network, fixed line, local area network, wide area network, and others, including any combination of these.

The computing device 406 may be configured to, for example, recognize the mat 402. This may be done for example if the computing device 406 may be configured to work with mats 402 with different alignment patterns thereon, the computing device 406 may recognize the mat 402 based on a user input, based on scanning a code on the mat 402 (e.g., a barcode, QR code, RFID tag, etc.), or by analyzing the alignment pattern and matching it with one stored in memory 410. The computing device 406 may also be configured to analyze the alignment pattern on the mat 402 and generate a new alignment pattern model with which to analyze the images and/or provide user feedback. In some embodiments, the mat 402 may include elements visible only to the imager (e.g., barcodes, QR codes, indications, alignment regions, etc.).

In some embodiments, the system is able to ascertain user attributes (e.g., user gait, proportions, height, and/or body type, etc.) and store them in the system associated with the user. These user attributes can be used to provide modified exercises, instruction, or feedback to the user. These user attributes may be enterable by the user or may be determined through a calibration step.

The computing device 406 may be configured to use the alignment pattern including any indications and alignment regions printed thereon to assess the user's alignment and/or positioning. The computing device 406 may be configured to assess the user's stance or movement based on the user's stance or movement relative to the indications or alignment regions. For example, the computing device 406 may be assessing the user for smooth and aligned movement within one alignment zone and may generate feedback or demerit the user's score when the user exits the alignment regions during the movement.

In some embodiments, the indications and alignment regions on the alignment pattern may assist the computing device 406 in interpreting and assessing the user's alignment and/or positioning. For example, in providing a plurality of parallel lines in a central region of the alignment pattern, the computing device 406 may be able to more readily ascertain the user's alignment in said region. Such advantages may enable the computing device 406 to focus on, for example, smaller segments of the images or to more easily and reliably verify determinations made by the system. Such improvements may render the system more computationally efficient or robust and replicable.

The computing device 406 may be configured generate feedback based the indications and alignment regions in the alignment pattern on mat 402. This may be incorporated into the feedback to more readily guide the user to a proper form or movement (e.g., instead of directing the user to adjust their position by 2 inches, the feedback may direct the user to bring a body part to, for example, the next indication). Feedback generated using visual indication visible to the user may be more readily and accurately actionable by the user.

In some embodiments, the imager may be configured to record the entire session or portions of the session during the user's use for later review. In some embodiments, the imager may be triggered to record based on a trigger (e.g., detection of poor alignment and/or positioning, specific poses which the user has historically struggled with, etc.) or external input (e.g., from an instructor device, etc.). The recorded portion can be replayed for review by the user and/or an instructor. In some embodiments, playback may include onscreen evaluations, recommendations, or other sophisticated features based on the specific system set up.

According to an aspect, there is provided a system 400 for user alignment. The system 400 includes a mat 402, a user alignment or positioning detector 404 (or, referring to FIG. 7, 710) configured to detect a user's alignment or positioning, and a computing device 406. The mat 402 having a top surface, a bottom surface, a length, a width, and a depth The mat top surface displays an alignment indication including a first set of indications defining alignment regions wherein the indications are proportional oblong shapes in a series of descending size wherein the largest oblong is proximate a medial portion of the mat 402 and the smallest oblong is proximate a lateral portion of the mat 402, a second set of indications defining alignment regions wherein the indications are proportional oblong shapes in a series of descending size wherein the largest oblong is proximate the medial portion of the mat 402 and the smallest oblong is proximate a lateral portion of the mat 402. The first set of indications mirrors the second set of indications and a medial length oriented region is defined in the medial space between the first set of indications and the second set of indications. The computing device 406 configured to receive the user's alignment or positioning from the user alignment or positioning detector 404 (or 710), generate alignment or positioning feedback based on the user's alignment or positioning and user information, and present the alignment or positioning feedback to the user.

In some embodiments, the oblong shapes of the first set of indications and the second set of indications each comprise one lengthwise side and two opposing widthwise sides.

In some embodiments, the lengthwise side is parallel to the lengthwise edge of the mat 402.

In some embodiments, the two opposing widthwise sides define an obtuse angle therebetween.

In some embodiments, the oblong shapes of the first set of indications and the second set of indications have rounded corners.

In some embodiments, the first and the second set of indications defining alignment regions comprise a set of boundary lines.

In some embodiments, the set of boundary lines are of variable weight.

In some embodiments, the first and the second set of indications defining alignment regions comprise at least one of a variation in color, luminosity, pattern, a combination of one or more of color, luminance and pattern.

In some embodiments, the regions are defined by a difference in gradient color and/or luminance wherein the difference comprises a lighter gradient color and/or luminance proximate the medial portion and a darker gradient color and/or luminance proximate a lateral portion.

In some embodiments, the first and the second set of indications defining alignment regions comprise a variation in texture, raised surface, and indented surface.

In some embodiments, the first and the second set of indications defining alignment regions comprise at least one of a variation in color, luminosity, pattern, a combination of one or more of color, luminance pattern, texture, raised surface, indented surface, and a combination thereof.

In some embodiments, each indication of the first and second sets of indications are spaced equally apart.

In some embodiments, one or more of alignment region is omitted from the first or second set of indications.

In some embodiments, the first set of alignment regions and the second set of alignment regions each contain 4-10 oblong shapes.

In some embodiments, the first set of alignment regions and the second set of alignment regions each contain 5-9 oblong shapes.

In some embodiments, the a user alignment or positioning detector 404 includes an imaging device 404. The imaging device 404 is directed at the mat top surface alignment indication and user position in relationship to the mat top surface alignment indication.

In some embodiments, the imaging device 404 is configured to recognize the first set of indications and second set of indications.

In some embodiments, the a user alignment or positioning detector 404 includes an imaging device 404. The imaging device 404 is directed at the mat top surface alignment indication and user position in relationship to the mat top surface alignment indication. The imaging device 404 is configured to recognize the first set of indications and second set of indications.

In some embodiments, the system 400 is further configured to, in conjunction with alignment indications and/or alignment regions, determine user position.

In some embodiments, the system 400 also includes a controller integrated into the mat, a connector, associated with the controller for transmitting data, at least one of an input sensor and an output indicator associated with one or more alignment region, indication defining an alignment region.

In some embodiments, the system 400 also includes at least one sensor input element associated with at least one of the alignment regions.

In some embodiments, the system 400 also includes at least one output indicator 412 to assist a user in alignment and positioning.

In some embodiments, the output indicator 412 comprises at least one of an audio output, a visual output, a tactile output, a thermal output.

In some embodiments, the system 400 also includes a controller integrated into the mat, a connector, associated with the controller for transmitting data, at least one of an input sensor and an output indicator associated with one or more alignment region, indication defining an alignment region. The system 400 also includes at least one sensor input element associated with at least one of the alignment regions. The system 400 also includes at least one output indicator 412 to assist a user in alignment and positioning. The output indicator 412 comprises at least one of an audio output, a visual output, a tactile output, a thermal output.

In some embodiments, one or more corner of the mat 402 is rounded.

In some embodiments, the depth of the mat 402 is formed by a set of layers of more than one type of material.

In some embodiments, a first layer is configured to grip floor surfaces, a second layer is configured for cushioning or stability, and a third layer for one or more of moisture wicking, gripping, and texturing.

In some embodiments, the depth of the mat 402 is formed by a set of layers of more than one type of material. A first layer is configured to grip floor surfaces, a second layer is configured for cushioning or stability, and a third layer for one or more of moisture wicking, gripping, and texturing.

In some embodiments, the mat 402 is fabricated from one or more of polyurethane, polyvinyl butyral, rubber, latex, polyester and nylon, or any suitable natural or synthetic thermoplastic elastomer.

In some embodiments, the alignment indication is formed by one or more screen printing, digital printing, sublimation printing, laser printing, UV printing, engraving, embossing, addition of a raised surface element, cut outs that reveal another surface, additional surfaces applied with an adhesive or heat bonding.

Connected Mats in Integrated Feedback Systems

In some embodiments, the mat comprises sensors to receive data on the user's alignment and/or positioning and a transceiver or such to transmit the data to a computing device (e.g., to be connected). The computing device may then assess the user's alignment and/or positioning, for example, by comparing the user alignment position to the target alignment position (or through some other method such as calculations regarding the user's stability, quality of movement, etc.), generate feedback based on the indications and/or alignment regions in the mat, and present or transmit the feedback for presentation. The user can use the visual landmarks on the mat to adjust their alignment and/or positioning. In some embodiments, the mat itself is configured to carry out some of the functionality of the computing device such as assessing user alignment and/or positioning and generating feedback, but transmitting the feedback to an output device. In some embodiments, the mat may be configured with output components (e.g., tactile feedback, a built in display, etc.) and can carry out all the functions of the computing device. In some embodiments, the computing device and/or the mat may receive additional information from external devices such as a server, instructor devices, or a digital content platform. These embodiments are described in greater detail below.

Embedded Sensors

In some embodiments, the mat may have embedded sensors to ascertain user alignment and/or positioning directly. In such embodiments, the embedded sensors may correspond or generally associate with the indications and/or alignment regions of an alignment pattern (as described in FIG. 1A-1D and FIG. 2). In some embodiments, the sensors may provide much higher alignment and/or positioning resolution (e.g., to determine further quality of movement or stability metrics).

Figure 5:
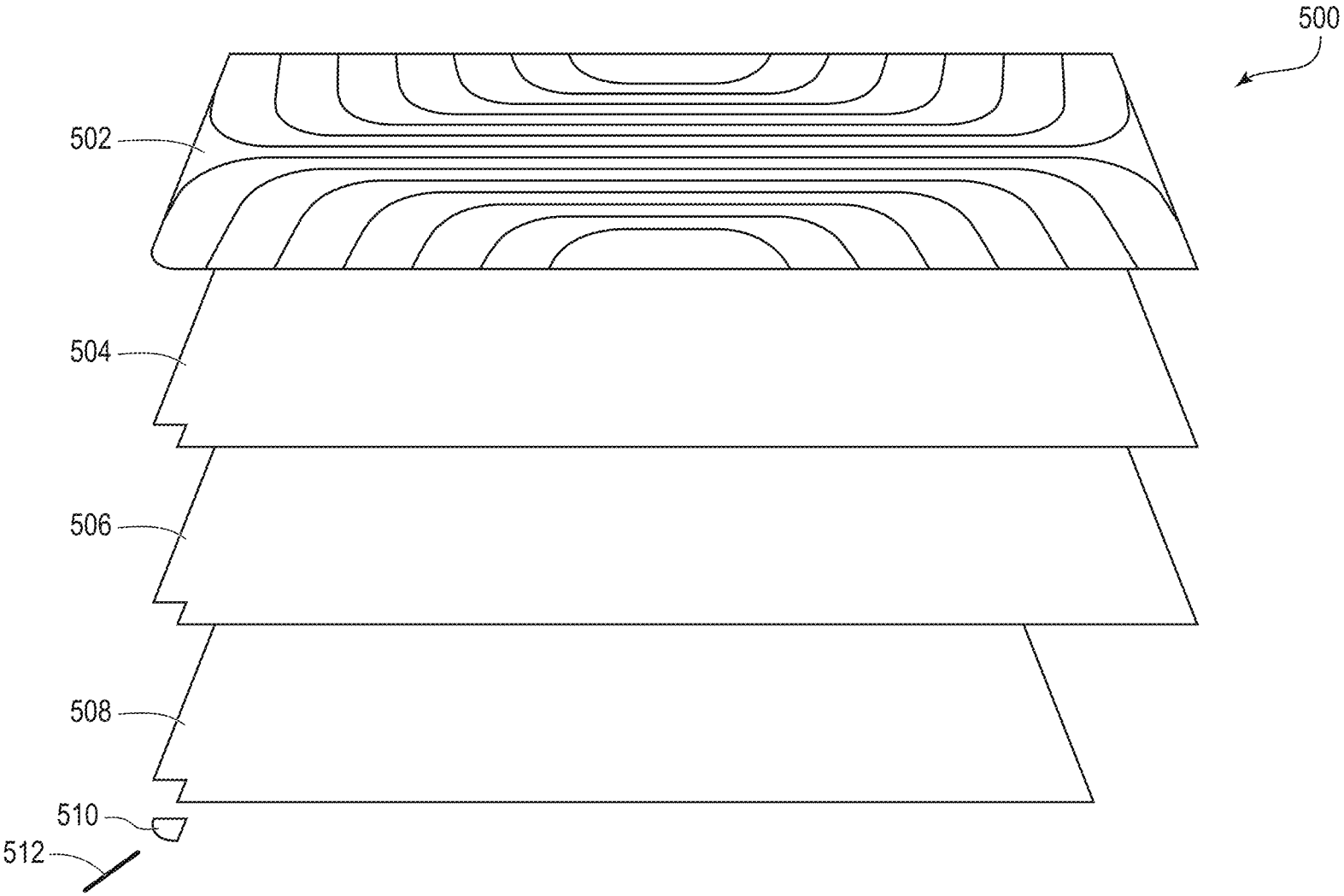
FIG. 5 illustrates an exploded view of a connected workout mat, according to some embodiments.

FIG. 5 illustrates an exploded view of a connected workout mat 500, according to some embodiments.

The connected workout mat 500 can comprise different layers that can be used to implement different input controls and/or output components as needed. For example, the workout mat 500 can have a non-slip textile surface layer 504 with an alignment pattern layer 502 including indications and alignment regions thereon, an optional multi-zone output layer (not shown), a sensor layer 506, and a mat base layer 508. As shown in FIG. 5, an example architecture of the connected workout mat 500 includes a pressure sensor 506, a non-slip top 504, and a natural rubber mat base 508. In some embodiments, layers may be combined and additional layers may be added. The pressure sensor layer 506 can provide data that can be processed to analyze user movements (e.g., alignment and/or positioning). For example, the non-slip textile surface 504 can be made of textiles with rubber deposited on the top, or three dimensional knitted composite textiles which embed rubber and textile into one layer. Example approximate dimensions of the connected workout mat 500 can be 1.8 m×1 m×7 mm thickness. These are illustrative example dimensions to provide utility in a range of different activities (e.g., HIIT, barre, yoga).

In some embodiments, the connected workout mat 500 can include a controller such as a low-power, removable controller 510 integrated into the mat 500 to consolidate signals from sensors of the sensor layer 506. The signals from the sensors can be input for the controller 510. The signals from the sensors can be processed to analyze user movements (e.g., alignment and/or positioning). The input controller 510 may process the data or transmit it to an external device for processing (described in greater detail below). The controller 510 can optionally activate different output components (should they be present). In some embodiments, the controller 510 can integrate with an LED button which is another example input control to select, for example, alignment position routines for execution. In some embodiments, the controller 510 can be designed to be thin to improve the aesthetic of the mat 500, reduce the risk of a user tripping on the mat 500, and to facilitate upgrades.

In some embodiments, a connector 512 transmits power to and data to and from the controller 510. In some embodiments, the connected workout mat 500 transmits the consolidated signals from the controller 510 to an external device by the connector 512. In some embodiments, the workout mat 500 is battery powered and data is transmitted wirelessly. The workout mat 500 configuration may vary to conserve battery usage.

Embedded Sensors and Outputs

In some embodiments, the mat may have sensors embedded in the mat which are capable of determining user alignment and/or positioning. The mat may be capable of transmitting this data to an external computing device or may have a computing device embedded in the mat to determine feedback to provide to the user. This feedback may be provided to the user using built-in output components which may be associated with the indications or alignment regions or which may provide feedback based on the indications or alignment regions (e.g., visual or verbal instructions based on the indications or alignment regions).

User alignment and/or positioning processing and feedback generation may be carried out on an external device (e.g., separate from the mat) or within a computing device housed within the mat. Though both options are viable, the following example with reference to FIG. 6 deals with the latter (computed in the mat).

Figure 6:
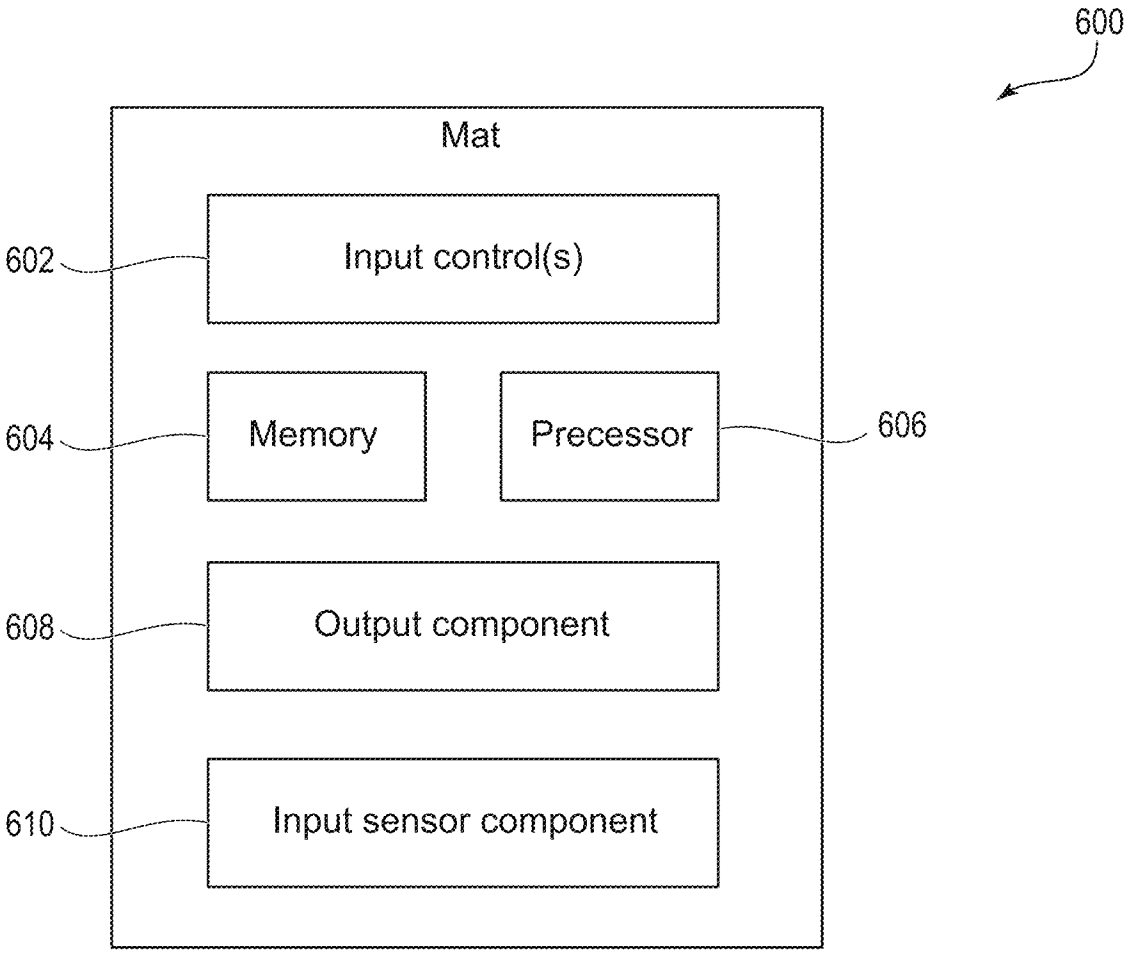
FIG. 6 illustrates an example embodiment of a workout mat with built-in sensors and output components, according to some embodiments.

FIG. 6 illustrates an example embodiment of a workout mat 600 with built-in sensors 610 and output components 608, according to some embodiments.

FIG. 6 shows an example embodiment of a workout mat 600 to enhance alignment and/or positioning using one or more sensors 610. The workout mat 600 comprises an input control 602 for receiving input from the user and controlling operations within the mat 600, a memory 604, a processor 606, an output component 608, and an input sensor component 610. The workout mat 600 may have an alignment pattern thereon including indications and alignment regions as described above with reference to FIG. 1A-1D and FIG. 2.

In some embodiments, the input control 602 may be operated through an interface on the mat 600. In some embodiments, the input control 602 may use inputs received from the input sensor component 610. For example, the user may be able to navigate forward or backward through options for alignment position routines by applying pressure to specific alignment regions and to make a selection by applying pressure to yet another alignment region. In some embodiments, the input control 602 can be a button integrated into the mat 600. In some embodiments, the input control 602 can be a touch display. In some embodiments, the mat 600 may use some combination thereof. In some embodiments, the input control 602 is a low-power controller integrated into the mat 600 to consolidate signals from sensors 610. The input controller 602 may receive power through a connector or by battery.

The workout mat 600 may have a memory 604 storing instructions for the programmed routines of alignment positions (e.g., a routine of poses and/or movements on which the mat 600 may assess the user and through which guide the user). The memory 604 may further include additional details such as a user's gait, proportions, height, and body type which may be used to modify routines of alignment positions.

The processor 606 may be configured to assess the user's alignment and/or positioning (e.g., against a target alignment position, based on quality of movement, stability, etc.), generate feedback to improve the user's alignment with reference to indications or alignment regions on the alignment pattern, and present the feedback via the output component 608 to guide the user to alignment based on the indications and alignment regions visible to the user.

In some embodiments, the input sensor component 610 detects a change in weight, touch, pressure, heat, light or the like on the surface of mat 600. In some embodiments, the sensor component 610 detects more than one input. The sensors may be arranged in a particular pattern that corresponds at least in part with the alignment pattern of the mat 600. In some embodiments, the sensor component 610 is able to detect the user's alignment and/or positioning.

In some embodiments, the workout mat 600 has an output component 608 to provide sensory output according to a selected pattern of mat output. The output component 608 can be integrated as part of the mat 600, or can include one or more devices connected to the mat 600 that are activated or triggered by control commands. In some embodiments, the output component 608 locations on the mat correspond partially or fully with indications or alignment regions to provide sensory output based indicating proper alignment and/or positioning.

In some embodiments, the output component 608 can include one or more heating, lighting, vibration, color changing or the like elements to generate sensory output to guide the user. In some embodiments the output component 608 can comprise a cooling output (e.g., refrigerated liquid cooling system, Peltier cooling elements, air forced through perforations in the mat itself, superconductive, low heat-capacity materials embedded in the mat 600, etc.), haptic output (e.g., in cell vibration motors, solenoids, electro-muscle stimulation (EMS), etc.), audio output (e.g., one or more speakers, etc.), airflow output (e.g., micro-channels in the connected workout mat 600, a fan type device, etc.), visual output (e.g., integrated lights, control commands sent to lighting devices coupled thereto, a digital interface or screens, etc.), notifications, statistics, or visual form feedback (e.g., at a digital interface or screen, etc.), smell outputs (e.g., through a peripheral device such as an infuser, etc.), or surface changes (e.g., texture or friction changes via electro-actuated textiles, etc.). In some embodiments, the outputs can be associated with specific zones which may or may not align with the indications and/or alignment regions.

In some embodiments, routines of alignment positions may be executed by mat 600. Any alignment positions may be modified based on contextual factors such as user gait, proportions, height, and body type to determine the appropriate alignment positions. The alignment positions may define target alignment positions or other performance metrics (e.g., quality of movement or stability) will be determined based on input from the input sensor component 610. The processor 606 may assess user performance and provide feedback to the user via the output components 608. For example, output may include audio or visual instruction to guide the user to proper alignment or positioning with reference to certain indications or alignment regions or other feedback (e.g., cooling, heating, haptic, airflow, etc.) to guide the user to certain indications or alignment regions.

In some embodiments, the input control 602 receives instructions for the sensory input and/or output from exercise content (e.g., provided from a server, user device, digital content platform, or instructor device), such that the instructions are embedded within the exercise content. In some embodiments, the input control 602 receives instructor input from an instructor device to modify the instructions for the sensory output and/or to select alignment position routines.

In some embodiments, mat 600 may work in tandem with a digital content platform (described in greater detail below) and synchronizes sensor inputs, signal processing, and outputs with content provided at the digital content platform.

According to an aspect, there is provided a workout mat 600 including a top surface, a bottom surface, a length, a width, a depth, and a controller 602. The mat top surface displays alignment indications including a first set of indications defining alignment regions wherein the indications are proportional oblong shapes in a series of descending size wherein the largest oblong is proximate a medial portion of the mat 600 and the smallest oblong is proximate a lateral portion of the mat 600, and a second set of indications defining alignment regions wherein the indications are proportional oblong shapes in a series of descending size wherein the largest oblong is proximate the medial portion of the mat 600 and the smallest oblong is proximate a lateral portion of the mat 600. The first set of indications mirrors the second set of indications and a medial length oriented region is defined in the medial space defined between the first set of indications and the second set of indications, and one or more sensor 610 integrated into the mat 100 and corresponding with one or more alignment indication configured to receive signals from the user. The controller 602 integrated into the mat configured to receive signals from the one or more sensor 610, and transmit the signals to a computing device.

In some embodiments, the oblong shapes of the first set of indications and the second set of indications each comprise one lengthwise side and two opposing widthwise sides.

In some embodiments, the lengthwise side is parallel to the lengthwise edge of the mat 600.

In some embodiments, the two opposing widthwise sides define an obtuse angle therebetween.

In some embodiments, the oblong shapes of the first set of indications and the second set of indications have rounded corners.

In some embodiments, the first and the second set of indications defining alignment regions comprise a set of boundary lines.

In some embodiments, the set of boundary lines are of variable weight.

In some embodiments, the first and the second set of indications defining alignment regions comprise at least one of a variation in color, luminosity, pattern, a combination of one or more of color, luminance and pattern.

In some embodiments, the regions are defined by a difference in gradient color and/or luminance wherein the difference comprises a lighter gradient color and/or luminance proximate the medial portion and a darker gradient color and/or luminance proximate a lateral portion.

In some embodiments, the first and the second set of indications defining alignment regions comprise a variation in texture, raised surface, and indented surface.

In some embodiments, the first and the second set of indications defining alignment regions comprise at least one of a variation in color, luminosity, pattern, a combination of one or more of color, luminance and pattern, texture, raised surface, indented surface, and combinations thereof.

In some embodiments, each indication of the first and second sets of indications are spaced equally apart.

In some embodiments, one or more of alignment region is omitted from the first or second set of indications.

In some embodiments, the first set of alignment regions and the second set of alignment regions each contain 4-10 oblong shapes.

In some embodiments, the first set of alignment regions and the second set of alignment regions each contain 5-9 oblong shapes.

In some embodiments, an imaging device is directed at the mat top surface alignment indication and user position in relationship to the mat top surface alignment indication.

In some embodiments, the imaging device is configured to recognize the first set of indications and second set of indications.

In some embodiments, an imaging device is directed at the mat top surface alignment indication and user position in relationship to the mat top surface alignment indication. The imaging device is configured to recognize the first set of indications and second set of indications.

In some embodiments, the mat is further configured to, in conjunction with alignment indications and/or alignment regions, determine user position.

In some embodiments, the mat 600 further includes at least one output indicator 608 to assist a user in alignment and positioning.

In some embodiments, the output indicator 608 comprises at least one of an audio output, a visual output, a tactile output, a thermal output.

In some embodiments, one or more corner of the mat 600 is rounded.

In some embodiments, the depth of the mat 600 is formed by a set of layers of more than one type of material.

In some embodiments, a first layer is configured to grip floor surfaces, a second layer is configured for cushioning or stability, and a third layer for one or more of moisture wicking, gripping, and texturing.

In some embodiments, the mat 600 is fabricated from one or more of polyurethane, polyvinyl butyral, rubber, latex, polyester and nylon, or any suitable natural or synthetic thermoplastic elastomer.

In some embodiments, the alignment indication is formed by one or more screen printing, digital printing, sublimation printing, laser printing, UV printing, engraving, embossing, addition of a raised surface element, cut outs that reveal another surface, additional surfaces applied with an adhesive or heat bonding.

Embedded Sensors and External Outputs

In some embodiments, the mat may have built-in sensors to detect the user's alignment and/or positioning. The mat may be configured to transmit this data to an external device to determine the feedback and provide the feedback externally. In some embodiments, the mat may be configured to receive position alignment routines to generate user feedback based on sensor data within the mat itself. Feedback may be provided by an external device (e.g., a mobile phone, a computing device, a digital content platform) and/or may also be optionally provided through the mat (e.g., through optional output components as described above). Feedback may be provided based on the indications and alignment regions (e.g., visual or audio instructions that reference the indications and alignment regions).

Figure 7:
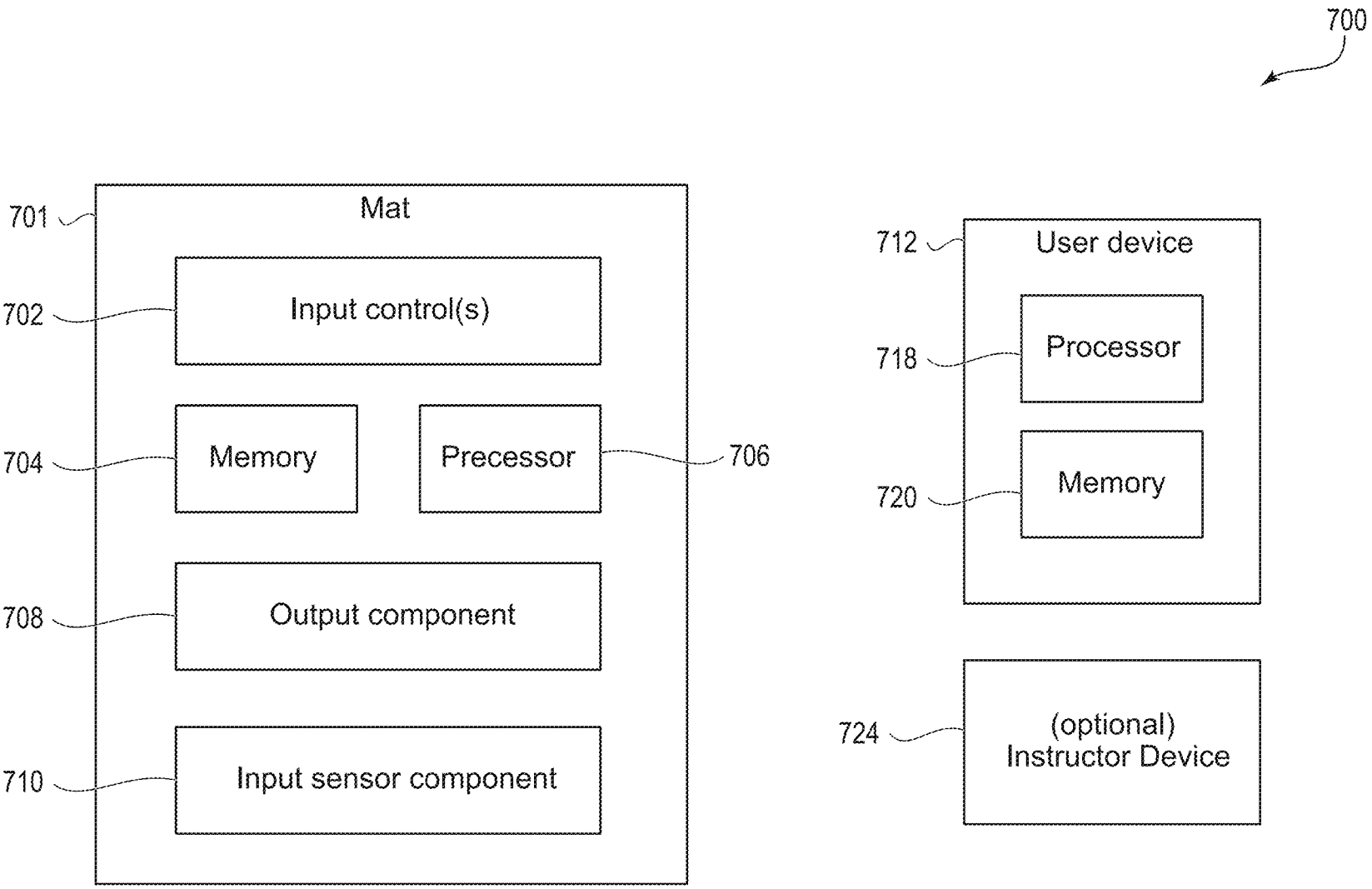
FIG. 7 illustrates an example system for a connected workout mat for use with a user device and/or digital content platform, according to some embodiments.

FIG. 7 illustrates an example system 700 for a connected workout mat 701 for use with a user device 712 and/or digital content platform (not shown), according to some embodiments.

The system 700 includes a mat 701, a user device 712, and an optional instructor device 724. The system 700 can detect user alignment and/or positioning data from sensors 710 on the mat 701, process the sensor data to generate feedback (on the mat 701 or on the user device 712), and present the user with feedback via the user device 712 (or output devices connected thereto) to assist the user with their alignment and positioning with reference to indications or alignment regions on the mat 701. In some embodiments, the workout mat 701 may be configured for use with an external output device such as a user device 712 (e.g., a mobile phone, for example, running a workout or yoga application) or a digital content platform. Such embodiments may provide the user with directed feedback based on the alignment pattern on the mat 701 via the user device 712 or digital content platform rather than via the mat 701 itself.

In some embodiments not illustrated, the workout mat 701 may include an input sensor component 710 and a component for transmitting the sensor data to the user device 712 or a digital content platform for data processing, feedback generation, and feedback presentation. The mat 701 also includes an alignment pattern made up of indications and alignment regions (as described with reference to FIG. 1A-1D and FIG. 2) which can be used to guide the user in the feedback provided.

The workout mat 701 illustrated in FIG. 7 comprises an input control 702, a memory 704, a processor 706, an input sensor component 710, and an optional output component 708 which may all provide similar variations and functionality as described for the same components described with reference to FIG. 6 described above. Functions described below as being carried out by input control 702 and/or processor 706 may be equally carried out by an external device such as user device 716 or a digital content platform. The connected workout mat 701 can have an input control 702.

The connected workout mat 701 has one or more input sensor component 710 to receive sensor data from a user. Sensor data is associated with an alignment model and at least one output component or device that generates alignment feedback for the user for evaluating alignment. In some embodiments, this alignment feedback is provided as sensory alignment guidance at the mat 701 by output component 708 as described above. In some embodiments this alignment feedback is provided on the user device 712 by a client application or on a digital content platform or other component.

In some embodiments, user device 712 (e.g. electronic device, mobile device) has a processor 718 and a memory 720 storing a client application executable by the processor. In this example, the user device 712 has a client application with an interface that can be used to generate a user profile (e.g., with context input such as user gait, proportions, height, and body type). In some embodiments, the client application can be used to select and/or modify a position alignments for the workout mat 701, and can provide control commands to the input control 702 of the workout mat 700 to optionally trigger the output component 708 to provide sensory alignment output at the workout mat 701.

The client application may serve one connected workout mat 701 or multiple connected workout mats 701. In some embodiments, the client application can have instructions to configure the processor to process video data capturing user movements to analyze user movements to trigger selections of different patterns of mat output.

In some embodiments, the outputs can be controlled by a remote instructor using an instructor device 724 to generate control commands that provide direct manipulation and control over a participant's physical workout to create and control the feedback (e.g., trigger feedback such as specific instructions with reference to indications or alignment regions on that user's mat (as opposed to different alignment patterns not used by that user) which may be modified suited to the user's gait, proportions, height, and body type). Instructors can be recorded in a live studio with a video camera and the captured video content can be played to the user (e.g., using their user device 712 or a digital content platform). The instructor can have the ability to control a connected workout mat 701, user device 712, or digital content platform through either interaction with their own mat, a (remote control) instructor device 724, an application, or through a signal given to a production crew.

In some embodiments, the digital content platform can be an immersive hardware device such as a camera device and display device integrated with a mirror. However, in some embodiments, the digital content platform is not an immersive hardware device, and can be a cloud server or computing device, for example. The digital content platform may be configured to present digital output such as video or music or display device proximate to the mat 701 that receives input data from the digital content platform. The digital output can involve personalized guidance such as guidance and instruction at the digital content platform which directs the user to align or position their body based on indications and/or alignment regions associated with the alignment pattern on their mat 701.

In some embodiments, the digital content platform may present content to a user, for example an exercise class. The content may include time information (e.g., timestamps and metadata) that can be used to synchronize the analysis of any sensor data from the mat 701 (to align user performance with relevant portions of, for example, the exercise). The time information may also configure outputs. In some embodiments, the digital content platform may be equipped with a camera and a display and can record and play back portions of the user's exercises for greater understanding of their movements.

According to an aspect, there is provided a system 700 for user alignment. The system 700 includes a mat 701, a user alignment or positioning detector 710 (or, referring to FIG. 4, 404) configured to detect a user's alignment or positioning, and a computing device 712. The mat 701 having a top surface, a bottom surface, a length, a width, and a depth The mat top surface displays an alignment indication including a first set of indications defining alignment regions wherein the indications are proportional oblong shapes in a series of descending size wherein the largest oblong is proximate a medial portion of the mat 701 and the smallest oblong is proximate a lateral portion of the mat 701, a second set of indications defining alignment regions wherein the indications are proportional oblong shapes in a series of descending size wherein the largest oblong is proximate the medial portion of the mat 701 and the smallest oblong is proximate a lateral portion of the mat 701. The first set of indications mirrors the second set of indications and a medial length oriented region is defined in the medial space between the first set of indications and the second set of indications. The computing device 712 configured to receive the user's alignment or positioning from the user alignment or positioning detector 710 (or 404), generate alignment or positioning feedback based on the user's alignment or positioning and user information, and present the alignment or positioning feedback to the user.

In some embodiments, the oblong shapes of the first set of indications and the second set of indications each comprise one lengthwise side and two opposing widthwise sides.

In some embodiments, the lengthwise side is parallel to the lengthwise edge of the mat 701.

In some embodiments, the two opposing widthwise sides define an obtuse angle therebetween.

In some embodiments, the oblong shapes of the first set of indications and the second set of indications have rounded corners.

In some embodiments, the first and the second set of indications defining alignment regions comprise a set of boundary lines.

In some embodiments, the set of boundary lines are of variable weight.

In some embodiments, the first and the second set of indications defining alignment regions comprise at least one of a variation in color, luminosity, pattern, a combination of one or more of color, luminance and pattern.

In some embodiments, the regions are defined by a difference in gradient color and/or luminance wherein the difference comprises a lighter gradient color and/or luminance proximate the medial portion and a darker gradient color and/or luminance proximate a lateral portion.

In some embodiments, the first and the second set of indications defining alignment regions comprise a variation in texture, raised surface, and indented surface.

In some embodiments, the first and the second set of indications defining alignment regions comprise at least one of a variation in color, luminosity, pattern, a combination of one or more of color, luminance, pattern, texture, raised surface, indented surface, and a combination thereof.

In some embodiments, each indication of the first and second sets of indications are spaced equally apart.

In some embodiments, one or more of alignment region is omitted from the first or second set of indications.

In some embodiments, the first set of alignment regions and the second set of alignment regions each contain 4-10 oblong shapes.

In some embodiments, the first set of alignment regions and the second set of alignment regions each contain 5-9 oblong shapes.

In some embodiments, the a user alignment or positioning detector 710 includes an imaging device. The imaging device is directed at the mat top surface alignment indication and user position in relationship to the mat top surface alignment indication.

In some embodiments, the imaging device is configured to recognize the first set of indications and second set of indications.

In some embodiments, the a user alignment or positioning detector 710 includes an imaging device. The imaging device is directed at the mat top surface alignment indication and user position in relationship to the mat top surface alignment indication. The imaging device is configured to recognize the first set of indications and second set of indications.

In some embodiments, the system 700 is further configured to, in conjunction with alignment indications and/or alignment regions, determine user position.

In some embodiments, the system 700 also includes a controller 702 integrated into the mat, a connector, associated with the controller for transmitting data, at least one of an input sensor 710 and an output indicator 708 associated with one or more alignment region, indication defining an alignment region.

In some embodiments, the system 700 also includes at least one sensor input element 710 associated with at least one of the alignment regions.

In some embodiments, the system 700 also includes at least one output indicator 708 to assist a user in alignment and positioning.

In some embodiments, the output indicator 708 comprises at least one of an audio output, a visual output, a tactile output, a thermal output.

In some embodiments, the system 700 also includes a controller 702 integrated into the mat, a connector, associated with the controller for transmitting data, at least one of an input sensor 710 and an output indicator 708 associated with one or more alignment region, indication defining an alignment region. The system 700 also includes at least one sensor input element 710 associated with at least one of the alignment regions. The system 700 also includes at least one output indicator 708 to assist a user in alignment and positioning. The output indicator 708 comprises at least one of an audio output, a visual output, a tactile output, a thermal output.

In some embodiments, one or more corner of the mat 701 is rounded.

In some embodiments, the depth of the mat 701 is formed by a set of layers of more than one type of material.

In some embodiments, a first layer is configured to grip floor surfaces, a second layer is configured for cushioning or stability, and a third layer for one or more of moisture wicking, gripping, and texturing.

In some embodiments, the depth of the mat 701 is formed by a set of layers of more than one type of material. A first layer is configured to grip floor surfaces, a second layer is configured for cushioning or stability, and a third layer for one or more of moisture wicking, gripping, and texturing.

In some embodiments, the mat 701 is fabricated from one or more of polyurethane, polyvinyl butyral, rubber, latex, polyester and nylon, or any suitable natural or synthetic thermoplastic elastomer.

In some embodiments, the alignment indication is formed by one or more screen printing, digital printing, sublimation printing, laser printing, UV printing, engraving, embossing, addition of a raised surface element, cut outs that reveal another surface, additional surfaces applied with an adhesive or heat bonding.

Additional Features of Connected Mats

In some embodiments, the mat may be configured to receive commands from the user through interaction with the mat. For example, the user may be able to scroll forward through options by tapping the alignment region in front of them (referring to FIG. 1A, alignment region 110*g*, for example) and backward by tapping the alignment region behind them (referring to FIG. 1A, alignment region 108*g*, for example). In some embodiments, the system may be configured to recognize specific interactions for specific actions (e.g., from user definitions or intelligent activity recognition). In some embodiments, the mat may have more conventional user input devices built into it. The mat may enable interaction through touch using pressure sensors, interactions through touch and air gestures using capacitance sensors. The mat may provide spatial location tracking (e.g., with ultrawide-band technology (UWB), sonar, or laser) or on-body location tracking (e.g., with UWB, ultra high frequency (UHF), inertial measurement unit, etc.).

The mat can include heart rate sensors, electroencephalography (EEG) sensors, blood pressure sensors, etc. The workout mat can capture input data to determine heart rate variability (HRV), respiratory rate, galvanic skin response, etc. The connected workout mat can capture speech and other audio input. The connected workout mat can have buttons and other input devices.

In some embodiments, the mat may be able to detect a user's balance and stability. For example, pressure sensors built into the connected workout mat can enable detection of balance and centre of pressure or detection of stability and jerk (a derivative of acceleration) of the user. The jerk in a user's movement can be determined by estimating postural sway and erratic movements on the connected workout mat. This could be bolstered with analysis of video footage by user or playback of video at instructor device. In some embodiments, balance may be inferred from stability on the mat (e.g., a user hopping, jerk, a user putting a foot down, the sway in the pressure reading, etc. can be used to determine that a user is unbalanced).

In some embodiments, the mat may be able to measure the rate of acceleration increase or decrease, or otherwise measure quality of movement (e.g., both within and between yoga poses). The quality of movement can be defined through, for example, the smoothness of transitions between, for example, poses, breath rate, heart rate, perceived challenge, and other biomarkers. In some embodiments, the system can compute a 'movement readiness' score whereby content is selected based on the stability and control a user's body shows in that specific session. For example, the user may be tired and fatigued and highly likely for injury so the workout mat selects easier workouts, or suggests that the user take it easy.

In some embodiments, the system can determine the center of pressure (COP). The COP is an average that can be determined from the pressure sensing elements. The COP can be determined by taking the raw data input and location of that input and averaging it across the area of the pressure applied. For example, one point at 0,0 can be 100 pressure, and the other point at 0,50 can be 0 pressure, then the COP can be at location 0,50, with a pressure of 50. The jerk in a user's movement can be determined by estimating postural sway and erratic movements on the connected workout mat. This could be bolstered with analysis of video footage by user or playback of video at instructor device.

In some embodiments, the system can capture user metrics as input data (e.g., repetition count, speed of movements, etc.). Captured data might be used to give feedback and encouragement to the user.

In some embodiments, the system can determine calories burned during an exercise session.

In some embodiments, the mat can provide a sensory experience using different output components devices (e.g., heating, cooling, vibration, haptics, sound, airflow, lighting, digital interface, smell, and surface material changes). These sensory experiences may be linked to exercise content with embedded instructions or driven for biological reasons (e.g., to help prevent the user from overheating).

In some embodiments, the system is able to ascertain user attributes (e.g., user gait, proportions, height, and/or body type, etc.) and store them in the system associated with the user. These user attributes can be used to provide modified exercises, instruction, or feedback to the user. These user attributes may be enterable by the user or may be determined through a calibration step.

In some embodiments, the mat contains an antenna type component (e.g. M6E-NANO) that can couple wirelessly to one or more peripherals, such as an instrumented object (for example a shoe or sock instrumented with a Gen 2 UHF 902-928 MHz RFID (GEN2) tag) to collect input data for further processing to generate different metrics or trigger different outputs. For example, the mat antenna can provide the ability to measure metrics (e.g. alignment position, repetitions, or velocity) relating to an instrumented object and also collect input data that can be used to derive information such as velocity and acceleration of specific movements through the use of radiofrequency technology, such as Ultra High Frequency (UHF) technology. The data can be used to, for example, receive further information about user alignment and/or positioning on the mat to tailor the feedback. The external mat antenna component can be designed robustly enough such that it can be incorporated into a bendable and rollable surface of a mat while still allowing the ability to measure participants above the surface (e.g. up to 3.6 meters). The user can be able to roll the full mat. The mat antenna component can collect input data that can be used to record and detect an alignment position, when a repetition has occurred, or the like when a user interacts with an instrumented object. The mat antenna component can output a signal in real-time. The mat antenna component can track multiple tags on different instrumented objects, such as radiofrequency (RFID) tags. The input data collected by the mat antenna component can be used by alignment mat to extrapolate velocity from the input data, for example.

Integrated Systems

As described above with reference to FIG. 4 and FIG. 7, mats may be implemented as part of an integrated system. In such systems, the mat may be used to receive information about the user's alignment and/or positioning (e.g., by visual inspection by an imaged as in FIG. 4 or from sensors embedded in the mat as in FIG. 7), process that information, and provide feedback to the user based thereon. Furthermore, such integrated systems may be able to offer additional optional functionality such as guiding the user through a routine, live training with an instructor, or uploading and downloading information from remote serves (e.g., for new routines or to track user progress).

Figure 8:
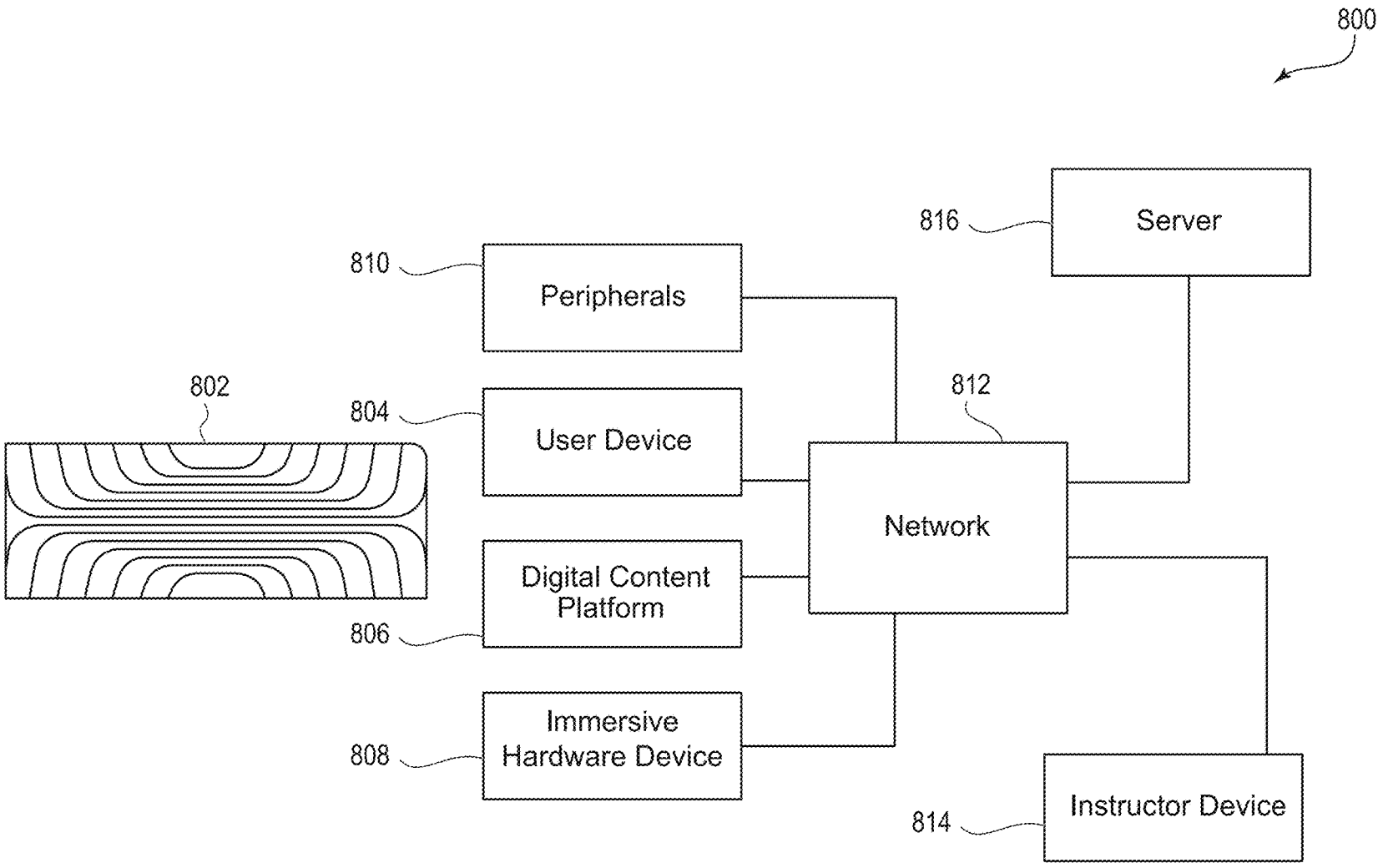
FIG. 8 illustrates an example architecture diagram of an integrated system for use with a mat, according to some embodiments.

FIG. 8 illustrates an example architecture diagram of an integrated system 800 for use with a mat 802, according to some embodiments.

The system 800 includes a connected workout mat 802, a user device 804, a digital content platform 806, immersive hardware device 808, peripherals 810, an instructor device 814, and server 816. The system 800 components may be connected via a network 812.

The components of the system 800 are provided by way of example only. Some components may not be pictured, though related functionality may be described (e.g., an imager). Some components pictured may nonetheless be omitted from the system 800 depending on the ultimate functionality. Functionality of some components can equally be carried out by other components.

The mat 802 can include an alignment pattern to assist the user in their alignment and positioning. The alignment pattern may be made up of indications and alignment regions (as described above with reference to FIG. 1A-1D and FIG. 2). In some embodiments, the mat 802 may include a sensors and an embedded processor (e.g., to send user alignment and/or positioning data or process it directly thereon). In some embodiments, the mat 802 may not include sensors, a processor, or any integrated elements and the system 800 receives alignment information based an external monitoring device (not shown, e.g., an imager as described above).

In embodiments where the mat 802 includes a processor or any integrated elements, then the mat 802 may be configured to process user alignment and/or positioning data thereon and provide feedback to the user (e.g., directly via embedded outputs in the mat 802 or via an external device). In such embodiments, the mat 802 may be configured to receive information from other components within the system 800 such as a guidance routine from, for example, a user device 804, a digital content platform 806, an instructor device 814, or a server 816. The mat 802 may further be configured to assess the user alignment and/or positioning in a time synchronous fashion such as in time with a guidance routine. The mat 802 may be configured enable content control which can include changes to playback of the content (e.g. play, pause, skip, forward, reverse), volume of instructor, volume of music, selection of content, and selection of quick-access features, such as a trigger to record an activity for review later, etc. The mat 802 can also control selections or modifications of alignment positions. User interactions may include taps in alignment regions or using specific zones that are defined to trigger specific features, patterns, controls or output.

The user device 804 may include, for example, a user's mobile phone running an application. In embodiments where the mat 802 does not include a processor or any integrated elements, then the user device 804 may be configured to receive alignment and/or positioning data from the user (e.g., from an imager as described above), process user alignment and/or positioning data, and provide feedback to the user (e.g., directly or via an external device). In such embodiments, the user device 804 may be configured to receive information from other components within the system 800 such as a guidance routine from, for example, an instructor device 814, or a server 816. The user device 804 may further be configured to assess the user alignment and/or positioning in a time synchronous fashion such as in time with a guidance routine.

In embodiments where the mat 802 includes a processor or any integrated elements, then the user device 804 may be configured to receive alignment and/or positioning data from the mat 802. Either the mat 802 or the user device 804 may be configured to process the data and present the user with feedback. The mat 802 and the user device 804 may be configured to provide complementary feedback. For example, the user device 804 may instruct the user to align their foot with the vibrating alignment region and the mat 802 simultaneously vibrates the relevant alignment region.

The digital content platform 806 may include for example a mirror with a camera, display, processor and other sensors. The digital content platform 806 may generally be configured to carry out the functions described above for the user device 804. Furthermore, the digital content platform may be configured to work with the user device 806. The digital content platform 806 may be an immersive hardware device, a server, network appliance, set-top box, embedded device, computer expansion module, mobile device, or any other computing device capable of being configured to carry out the operations described herein.

The digital content platform 806 may additionally trigger the capture of a video recording of a user's exercise session (or portions thereof) and playback of the captured video at the digital content platform 806. The video feature can enable different functionalities, such as review of a pose (e.g. playback of video either at end of workout or during the workout by the user or the instructor to aid in corrections and understanding of form), detection of a pose (e.g. automatic recognition of movements or poses in the video), and holding a pose (e.g. when user taps button to trigger video capture and the user focuses on their pose which is captured by video). The digital content platform 806 can enable participants to review a video of themselves doing various poses with or without a remote instructor.

In one embodiment where the mat 802 includes pressure sensors, a pressure map profile can also be reviewed. The video and the pressure profile can be synchronized, for example.

The immersive hardware device 808 can have a display device to deliver content (e.g. exercise content) and can have other output components (e.g. speakers) to provide sensory output to user. The immersive hardware device 808 can have input devices such as a camera to capture input data (e.g., to act as an imager). The immersive hardware device 808 can include, for example, a VR headset.

There can be one or more peripherals 810 to provide input devices to capture input data and/or output devices to provide sensory output to the user.

The system 800 components may be connected in various ways including directly coupled, indirectly coupled via a network 812, and distributed over a wide geographic area and connected via a network 812.

In some embodiments, some components of the system 800, such as the peripherals 810 and immersive hardware device 808 may be directly coupled to another component such as the user device 804 and/or digital content platform 806 and receive instructions through said components. In such embodiments, the user device 804 and/or digital content platform 806 may be in communication with other components such as the server 816 and instructor device 814 via the network 812.

The server 816 may provide information to any one of the mat 802, the user device 804, the digital content platform 806, the immersive hardware device 808, and the peripherals 810. In some embodiments, the server 816 can store trained models to reduce computational power needed at the mat 802, user device 804, and/or digital content platform 806. In this way, more complex computations can be executed in the server 816 and the result (e.g. trained models) can be returned efficiently to the mat 802, user device 804, and/or digital content platform 806. The server 816 may store instructions for different alignment position routines, for example.

In some embodiments, the server 816 may comprise multiple servers 816 which may further be configured to carry out different functions. For example, a server 816 may have, for example, a web application with context metadata and a pattern generator. Another server 816 can have a pattern generator and a pattern repository. Another server 816 can store models and have a database of content. In some embodiments, a server 816 can have a hardware processor and memory storing context metadata, a pattern generator, models, a pattern repository, and a content repository. Context metadata can include, for example, selected exercise content of a digital content platform. The pattern repository can be used to retrieve one or more patterns of map output (e.g., to provide stimulus by the mat 802 where capable of providing stimulus). The patterns can provide stimulus based on, for example, exercise content to synchronize the exercise with the stimulus. Pattern generator can generate patterns based on content data, user input, instructor input, and other data sets. Patterns can then be stored in the pattern repository. In some embodiments, patterns may be modified based on user attributes such as gait, proportion, height, and body type.

In some embodiments, the system 800 has an instructor device 814 that provides control commands to the server 816 or mat 802 to modify the pattern of map output. In some embodiments, the outputs are controlled by a remote instructor device 814 for direct manipulation and control of a workout experience through a range of outputs comprising audio or visual through any one of the mat 802, user device 804, digital content platform 806, and heating, cooling, and vibration exhibited through the connected mat. In some embodiments, the instructor device 814 may be used to present a routine to a plurality of users and the instructor device 814 may be configured to provide feedback from the instructor to specific users (e.g., if the instructor sees that a user is struggling, they can send a modified pose to a particular user's device or digital content platform without other user's being notified).

In some embodiments, the system 800 has a user device 804 with a client application with a user interface to generate a user profile to define one or more attributes for the routines for the alignment mat 802. For example, the user device 804 may take information about the user's gait, proportions, height, or body type to modify routines (e.g., to update proper foot placement based on likely width of stance) or ask the user to calibrate the mat 802 (e.g., to receive information about the user's natural stance directly from the mat 802 or through another device such as an imager). The system 800 can generate one or more alignment position routines or patterns of mat output using the attributes, data in the user profile, and pattern generator. The system 800 can retrieve one or more patterns of mat output using the attributes, data in the user profile, and pattern repository. The system 800 can also store routines on memory of mat 802.

In some embodiments, the hardware processor processes the input data using a trained model. In some embodiments, the hardware processor updates the trained model based on data captured from other users. In some embodiments, the hardware processor trains the trained model based on user data.

Methods

The systems of any one of FIG. 4, FIG. 6, FIG. 7, FIG. 8 or variations or derivatives based thereon are capable of providing feedback to the user based on their alignment.

Figure 9:
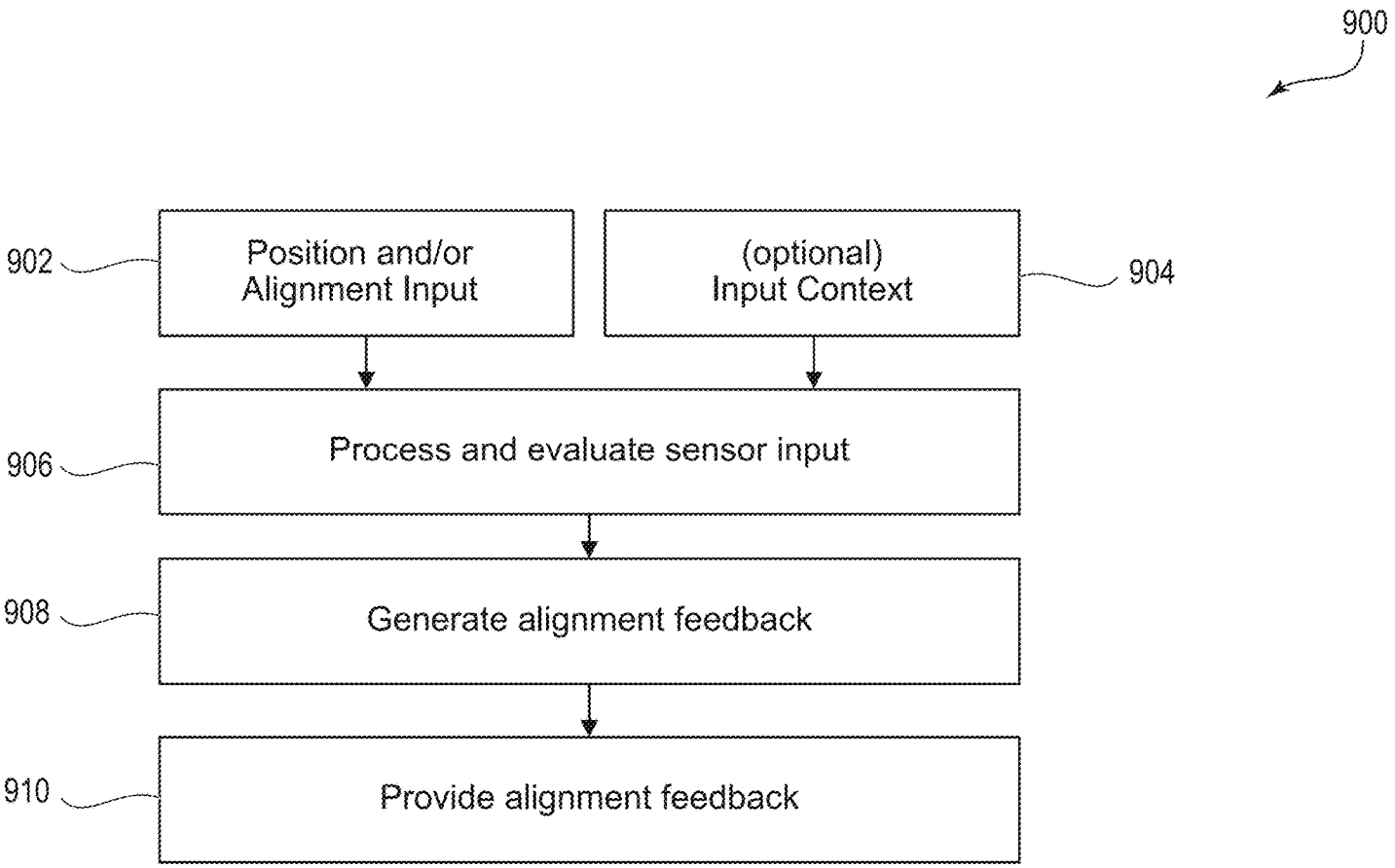
FIG. 9 is an example of a process flow diagram for a system capable of providing feedback to the user, according to some embodiments.

FIG. 9 is an example of a process flow diagram for a system capable of providing feedback to the user, according to some embodiments.

The alignment and/or positioning data can be received from sensors within the mat or based on images captures during use of the mat. The alignment and/or positioning can be based on an alignment pattern (e.g., indications and alignment regions) that is visible on mat without the use of a connected/technology-based system.

Detected activity can be used to select alignment position routines from a repository of patterns, for example. The activity can also be linked to content with embedded instructions, as another example. The activity can be a series of activities detected at the mat. For example, an activity can be defined as a duration of activity and of a series of activities, including patterns within the series of activities.

At block 902, input activity can be captured by the mat or by an external sensor (e.g., an imager).

At block 904, input context can be captured by the system. The input context can include user preference, user height, user weight, user proportions, user gait, activity selection, instructor input, community input, etc. For example, a context input might shift the expected alignment position to match the user's height and a series of yoga positions/postures. As another example, a context input might shift the instructions regarding how the user is to align with the alignment position to match the user's height during selected activities. A portion of the input data can be provided by a connected architecture in some embodiments.

At block 906, the system can process the input data (input activity and input context) based on instructions and models stored at a memory. In some embodiments, this includes creating a data set that compares a user alignment position with a target alignment position, a series of user alignment positions with a series of target alignment positions or the like. The target alignment positions may be based on user attributes or other input context.

At block 908, the system can generate feedback based on differences between the user alignment position and the target alignment position (or, e.g., quality of movement, stability, etc.). The alignment feedback can incorporate references to indication and alignment regions on the mat. The feedback may incorporate context input to tailor the alignment guidance based on the alignment pattern and the user's, for example, height. For example, for individuals with a broader stance, the system may automatically recommend that they align their feet with a wider stance associated with a specific indication and/or alignment region on the alignment pattern whereas the system may automatically recommend that an individual with a narrower stance receiving similar feedback align their feet with a different narrower indication and/or alignment region on the alignment pattern.

In some embodiments, alignment indicators are provided through output components in the mat which may be associated with indications and/or alignment regions.

At block 910, providing alignment feedback can be performed at a user device, digital content platform, the mat, the like, or combinations. The feedback may reference the indications and/or the alignment regions on the alignment pattern to guide the user. Feedback may be provided real time while the activity is being performed, afterwards as a summary, embedded within a larger set of training guidance, or a combination. Feedback may include graphs, charts, images showing recommended posture/position modifications, alignment guidance output indicators incorporated in the mat such as heating, sound, spoken guidance, text guidance, vibration, lighting, color changing, alignment output indicators or a combination.

In some embodiments, the method 900 involves generating the alignment instructions by processing the input data by a hardware processor using a trained model at block 906.

In some embodiments, the method 900 involves identifying an activity from stored information that comprises at least one of a standard series for an activity type, a repetitive series, or a progressive series. In some embodiments, an activity comprises a series of related activities. In some embodiments, the method involves associating a time duration with the activity. Accordingly, the method 900 can generate alignment position instructions based on the activity. In some embodiments, the method 900 involves generating alignment position instructions based on the time duration associated with the activity. In some embodiments, the activity is associated with an activity type. In some embodiments, the input data identifying the activity is received from a connected digital platform. In some embodiments, the input data identifying the activity is received from a pre-recorded activity. In some embodiments, the input data identifying the activity is received from an audio input.

In some embodiments, the method 900 involves determining the selected alignment position by signal and data filtering of input data by a hardware processor; and processing the input data by the hardware processor using a trained model (block 906). In some embodiments, the method 900 involves updating the trained model over time based at least on one dataset where the dataset relates to at least one of user specific data, household specific data, ambient environment data, community data, expert data, instructor data, user goal data, community goal data, instructor goal data. In some embodiments, the method 900 involves training the trained model with data from at least one of community data, expert data, instructor data.

In some embodiments, the method 900 involves generating feedback at block 908 using a trained model. The trained model may provide feedback based on indications and/or alignment regions of an alignment pattern. In some embodiments, the method 900 updates the trained model over time based on feedback that has been effective (or not effective) for at least one specific user or a population or users.

In some embodiments, the method 900 involves providing exercise content from at least one of the digital content platform and synchronizing the alignment position with the exercise content provided by the digital content platform.

In an aspect, there is provided a non-transient computer readable medium containing program instructions for causing a computer to perform method 900 and any variations thereon.

Computer Implementation Details

Figure 10:
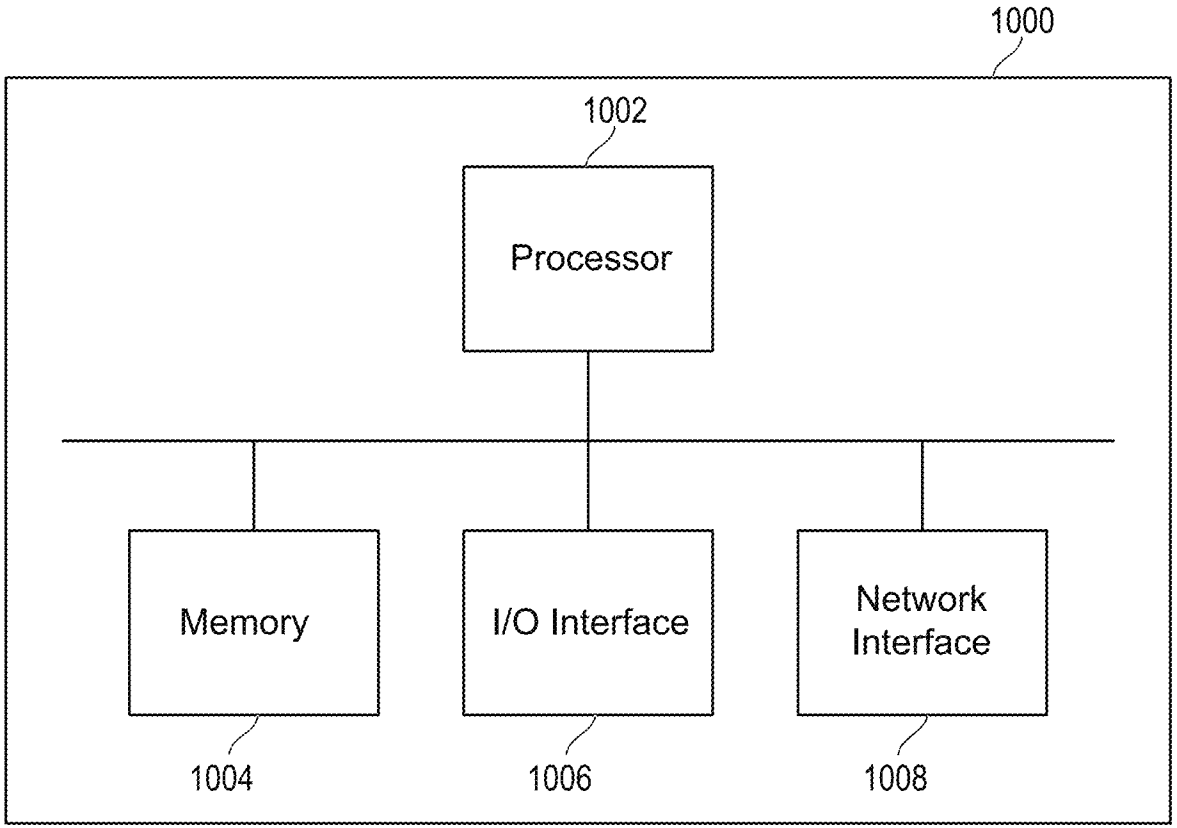
FIG. 10 illustrates a schematic diagram of computing device, according to some embodiments.

FIG. 10 illustrates a schematic diagram of computing device 1000, according to some embodiments.

Computing device 1000 may be generally representative of possible implementations of computing device 406, controller 510, mat 600, mat 701, user device 712, instructor device 724, user device 804, digital content platform 806, instructor device 814, and server 816. As depicted, computing device 1000 includes at least one processor 1002, memory 1004, at least one I/O interface 1006, and at least one network interface 1008.

Each processor 1002 may be, for example, any type of general-purpose microprocessor or microcontroller, a digital signal processing (DSP) processor, an integrated circuit, a field programmable gate array (FPGA), a reconfigurable processor, a programmable read-only memory (PROM), or any combination thereof.

Memory 1004 may include a suitable combination of any type of computer memory that is located either internally or externally such as, for example, random-access memory (RAM), read-only memory (ROM), compact disc read-only memory (CDROM), electro-optical memory, magneto-optical memory, erasable programmable read-only memory (EPROM), and electrically-erasable programmable read-only memory (EEPROM), Ferroelectric RAM (FRAM) or the like.

Each I/O interface 1006 enables computing device 1000 to interconnect with one or more input devices, such as a keyboard, mouse, camera, touch screen and a microphone, or with one or more output devices such as a display screen and a speaker.

Each network interface 1008 enables computing device 1000 to communicate with other components, to exchange data with other components, to access and connect to network resources, to serve applications, and perform other computing applications by connecting to a network (or multiple networks) capable of carrying data including the Internet, Ethernet, plain old telephone service (POTS) line, public switch telephone network (PSTN), integrated services digital network (ISDN), digital subscriber line (DSL), coaxial cable, fiber optics, satellite, mobile, wireless (e.g. Wi-Fi, WiMAX), SS7 signaling network, fixed line, local area network, wide area network, and others, including any combination of these.

Computing device 1000 is operable to register and authenticate users (using a login, unique identifier, and password for example) prior to providing access to applications, a local network, network resources, other networks and network security devices. Computing devices 1000 may serve one user or multiple users.

Implementation Details

The foregoing discussion provides many example embodiments. Although each embodiment represents a single combination of inventive elements, other examples may include all possible combinations of the disclosed elements. Thus if one embodiment comprises elements A, B, and C, and a second embodiment comprises elements B and D, other remaining combinations of A, B, C, or D, may also be used.

The term "connected" or "coupled to" may include both direct coupling (in which two elements that are coupled to each other contact each other) and indirect coupling (in which at least one additional element is located between the two elements).

The technical solution of embodiments may be in the form of a software product. The software product may be stored in a non-volatile or non-transitory storage medium, which can be a compact disk read-only memory (CD-ROM), a USB flash disk, or a removable hard disk. The software product includes a number of instructions that enable a computer device (personal computer, server, or network device) to execute the methods provided by the embodiments.

Although the embodiments have been described in detail, it should be understood that various changes, substitutions and alterations can be made herein without departing from the scope as defined by the appended claims.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized. Accordingly, the appended claims are intended to include within their scope such processes, machines, manufacture, compositions of matter, means, methods, or steps.

As can be understood, the examples described above and illustrated are intended to be exemplary only. The scope is indicated by the appended claims.

What is claimed is:

1. A workout mat for user alignment comprising:

a mat having a top surface, a bottom surface, a length, a width having a smaller dimension than the length, and a depth; and wherein the mat top surface displays an alignment indication comprising:

a first set of indications defining alignment regions wherein the first set of indications comprises proportional oblong shapes in a series of descending size wherein each of the oblong shapes is defined by a single unitary line and wherein the largest oblong is proximate a medial portion of the mat, the smallest oblong is proximate a lateral portion of the mat, and the oblong shapes are spaced apart and separate from one another;

a second set of indications defining alignment regions wherein the second set of indications comprises proportional oblong shapes in a series of descending size wherein each of the oblong shapes is defined by a single unitary line and wherein the largest oblong is proximate the medial portion of the mat, the smallest oblong is proximate a lateral portion of the mat, and the oblong shapes are spaced apart and separate from one another; and wherein the first set of indications mirrors the second set of indications about a length oriented medial line and a medial length oriented region is defined in the medial space between the first set of indications and the second set of indications.

2. The workout mat of claim 1, wherein the oblong shapes of the first set of indications and the second set of indications each comprise one lengthwise side and two opposing widthwise sides.

3. The workout mat of claim 2, wherein the lengthwise side is parallel to the lengthwise edge of the mat.

4. The workout mat of claim 2, wherein the two opposing widthwise sides define an obtuse angle therebetween.

5. The workout mat of claim 1, wherein the oblong shapes of the first set of indications and the second set of indications have rounded corners.

6. The workout mat of claim 1, wherein the first and the second set of indications defining alignment regions comprise a set of boundary lines.

7. The workout mat of claim 6, wherein the set of boundary lines are of variable weight.

8. The workout mat of claim 1, wherein the first and the second set of indications defining alignment regions have a variation in color, luminosity, pattern, texture, raised surface, indented surface, or a combination thereof.

9. The workout mat of claim 8, wherein the regions are defined by a difference in gradient color and/or luminance wherein the difference comprises a lighter gradient color and/or luminance proximate the medial portion and a darker gradient color and/or luminance proximate a lateral portion.

10. The workout mat of claim 1, wherein one or more of alignment region is omitted from the first or second set of indications.

11. The workout mat of claim 1, wherein the first set of alignment regions and the second set of alignment regions each contain 4-10 oblong shapes.

12. The workout mat of claim 11, wherein the first set of alignment regions and the second set of alignment regions each contain 5-9 oblong shapes.

13. The workout mat of claim 1, wherein an imaging device is directed at the mat top surface alignment indication and user position in relationship to the mat top surface alignment indication, and wherein the imaging device is configured to recognize the first set of indications and second set of indications.

14. The workout mat of claim 1, further configured to, in conjunction with alignment indications and/or alignment regions, determine user position.

15. The workout mat of claim 1, further comprising a controller integrated into the mat, a connector, associated with the controller for transmitting data, at least one of an input sensor and an output indicator associated with one or more alignment region, indication defining an alignment region, wherein at least one sensor input element is associated with at least one of the alignment regions, wherein at least one output indicator assists a user in alignment and positioning, and wherein the output indicator comprises at least one of an audio output, a visual output, a tactile output, a thermal output.

16. The workout mat of claim 1, wherein the depth of the mat is formed by a set of layers of more than one type of material, and wherein a first layer is configured to grip floor surfaces, a second layer is configured for cushioning or stability, and a third layer for one or more of moisture wicking, gripping, and texturing.

17. The workout mat of claim 1, wherein the mat is fabricated from one or more of polyurethane, polyvinyl butyral, rubber, latex, polyester and nylon or any suitable natural or synthetic thermoplastic elastomer.

18. The workout mat of claim 1, each indication of the first and second sets of indications are spaced equally apart.

19. The workout mat of claim 1, wherein the alignment indication is formed by one or more screen printing, digital printing, sublimation printing, laser printing, UV printing, engraving, embossing, addition of a raised surface element, cut outs that reveal another surface, additional surfaces applied with an adhesive or heat bonding.

20. The workout mat of claim 1, wherein the top surface is devoid of lines that intersect in a grid pattern.

* * * * *